United States Patent [19]

Kobayashi et al.

[11] Patent Number: 4,725,530

[45] Date of Patent: Feb. 16, 1988

[54] SILVER HALIDE COLOR PHOTOGRAPHIC MATERIAL

[75] Inventors: Hidetoshi Kobayashi; Toshihiro Nishikawa, both of Kanagawa, Japan

[73] Assignee: Fuji Photo Film Co., Ltd., Kanagawa, Japan

[21] Appl. No.: 920,224

[22] Filed: Oct. 17, 1986

[30] Foreign Application Priority Data

Oct. 18, 1985 [JP] Japan ..... 60-232625

[51] Int. Cl.[4] ..... G03C 1/08; G03C 7/26; G03C 7/32

[52] U.S. Cl. ..... 430/505; 430/381; 430/384; 430/385; 430/504; 430/544; 430/548; 430/552; 430/553; 430/957

[58] Field of Search ..... 430/381, 384, 385, 552, 430/553, 548, 544, 957, 504, 505

[56] References Cited

U.S. PATENT DOCUMENTS

| | | | |
|---|---|---|---|
| 4,228,070 | 10/1980 | Milner et al. | 534/648 |
| 4,254,212 | 3/1981 | Yagihara et al. | 430/381 |
| 4,296,199 | 10/1981 | Yagiharu et al. | 430/551 |
| 4,433,050 | 2/1984 | Abe et al. | 430/542 |
| 4,444,870 | 4/1984 | Hirano et al. | 430/381 |
| 4,455,366 | 6/1984 | Hirano et al. | 430/381 |
| 4,495,272 | 1/1985 | Yasihara et al. | 430/381 |
| 4,511,647 | 4/1985 | Hirano et al. | 430/381 X |
| 4,518,667 | 5/1985 | Hirano et al. | 430/381 X |
| 4,560,645 | 12/1985 | Toriuchi et al. | 430/562 |
| 4,584,263 | 4/1986 | Takahashi | 430/372 X |
| 4,601,975 | 7/1986 | Koboshi et al. | 430/400 X |
| 4,647,527 | 3/1987 | Ikenoue et al. | 430/505 |

FOREIGN PATENT DOCUMENTS

| | | |
|---|---|---|
| 0071402 | 2/1983 | European Pat. Off. . |
| 106211 | 4/1984 | European Pat. Off. . |
| 0161626 | 11/1985 | European Pat. Off. . |

*Primary Examiner*—Mukund J. Shah

*Attorney, Agent, or Firm*—Birch, Stewart, Kolasch & Birch

[57] ABSTRACT

A silver halide color photographic material comprising a support and at least one red-sensitive emulsion layer, at least one green-sensitive emulsion layer and at least one blue-sensitive emulsion layer on the support, which contains at least one cyan dye forming coupler represented by the general formula (I) and at least one cyan dye forming coupler represented by the general formula (II):

(I)

(II)

wherein $R_1$ represents $—CONR_5R_6$, —NHCORhd 5, $—NHCOOR_7$, $—NHSO_2R_7$, $—NHCONR_5R_6$ or $—NHSO_2NR_5R_6$, $R_2$ represents a group which can be substituted in the naphthol ring, m represents 0 or an integer of 1 to 3, $R_3$ represents a monovalent group, $R_4$ represents an aromatic group, and X and Y each represents a hydrogen atom or a group capable of leaving through a coupling reaction with an oxidized product of aromatic primary amine developing agent; $R_5$ and $R_6$ may be the same or different and each represents a hydrogen atom, an aliphatic group, an aromatic group or a heterocyclic group, and $R_7$ represents an aliphatic group, an aromatic group or a heterocyclic group.

23 Claims, 1 Drawing Figure

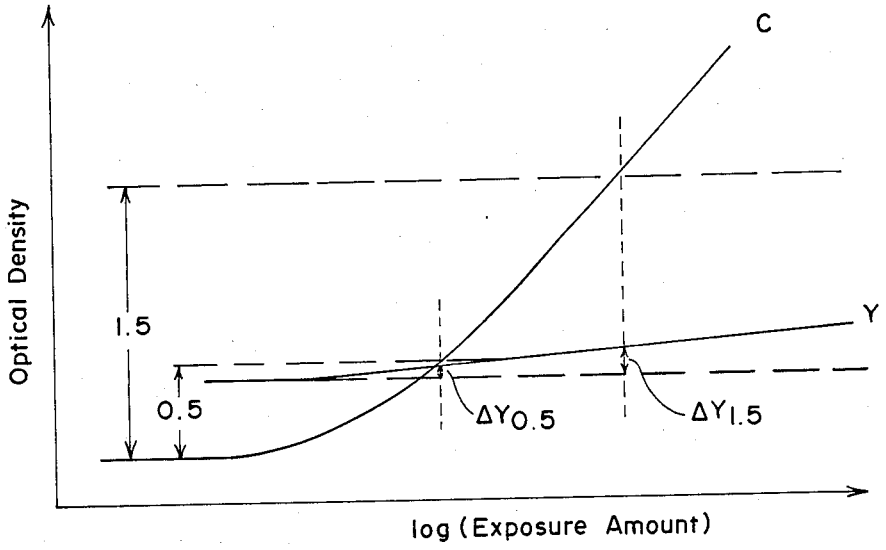
C
Y
Optical Density
1.5
0.5
ΔY0.5
ΔY1.5
log (Exposure Amount)

SILVER HALIDE COLOR PHOTOGRAPHIC MATERIAL

FIELD OF THE INVENTION

The present invention relates to a silver halide color photographic material, and more particularly, to a silver halide color photographic material which even when processed with a fatigued or low oxidation power bleaching solution or bleach-fixing solution, produces an image which is free from a reduction in color density and is excellent in storage stability, and furthermore which is inexpensive and is excellent in production suitability and color reproduction.

BACKGROUND OF THE INVENTION

Upon color development of a silver halide photographic material after imagewise exposure, an oxidized aromatic primary amine developing agent reacts with a dye-forming coupler (hereinafter referred to as a "coupler"), thereby forming a dye image.

Couplers which are used in recent color photographic materials must meet various requirements, such as high stability, high processing suitability, excellent color forming properties and an ability to produce a color image excellent in hue, as well as having fastness, low cost and high production suitability.

As cyan couplers, phenol-based and naphthol-based couplers have heretofore been used. In particular, 1-naphthol-based couplers have been widely used in color negative light-sensitive materials because the maximum absorption (λmax) of the color-forming dye which they produce is in a longer wavelength side and the sub-absorption of the color-forming dye is decreased in the green-light region. Moreover, such couplers are excellent in color reproduction, are often excellent in color forming properties, are inexpensive and further are excellent in production suitability.

However, conventionally used phenol-based and naphthol-based couplers, particularly 2-alkylcarbamoyl-1-naphthol-based couplers, have the disadvantage that when processed with a fatigued or low oxidation power bleaching solution or bleach-fixing solution at the bleaching or bleach-fixing step of color development, they fail to produce a color image of sufficiently high color density. The reason for this is believed to be ascribable to reduction color fading of a cyan dye, for example, which is caused by ferric ions formed at the bleaching or bleach-fixing step. Furthermore, the above couplers also have the disadvantage that they produce a cyan image of low fastness.

The former disadvantage of the naphthol-based couplers as described above can be eliminated by changing the substituent of the carbamoyl group in the 2-position from an alkyl group to an aryl group, that is, by using 2-arylcarbamoyl-1-naphthol-based couplers (as described in U.S. Pat. No. 3,488,193, for example). However, it is impossible to eliminate the latter disadvantage even if the above couplers are used. Furthermore, from the viewpoint of image storage stability, it is now always desirable to use such couplers exclusively as the cyan couplers.

Of the naphthol-based couplers, 1-naphthol-based couplers having a specified substituent in the 5-position as described in European Patent No. 161,626 A2 are free of the disadvantages discussed above and are excellent in performance, but they suffer from the following disadvantages. That is, they are expensive to prepare them because many steps are needed in the preparation thereof. In addition, the degree of freedom in providing such couplers is small due to limitations in the preparation thereof. For reference, typical schemes for the preparation of 4-equivalent couplers are shown below. In these cases, as the starting materials, compounds described in *Chemicals Guide,* Kagaku Kogyo Jiho Co., Ltd., 1984–1985 ed., are used.

5-Position Substituted Type 1-Naphthol-Based Couplers

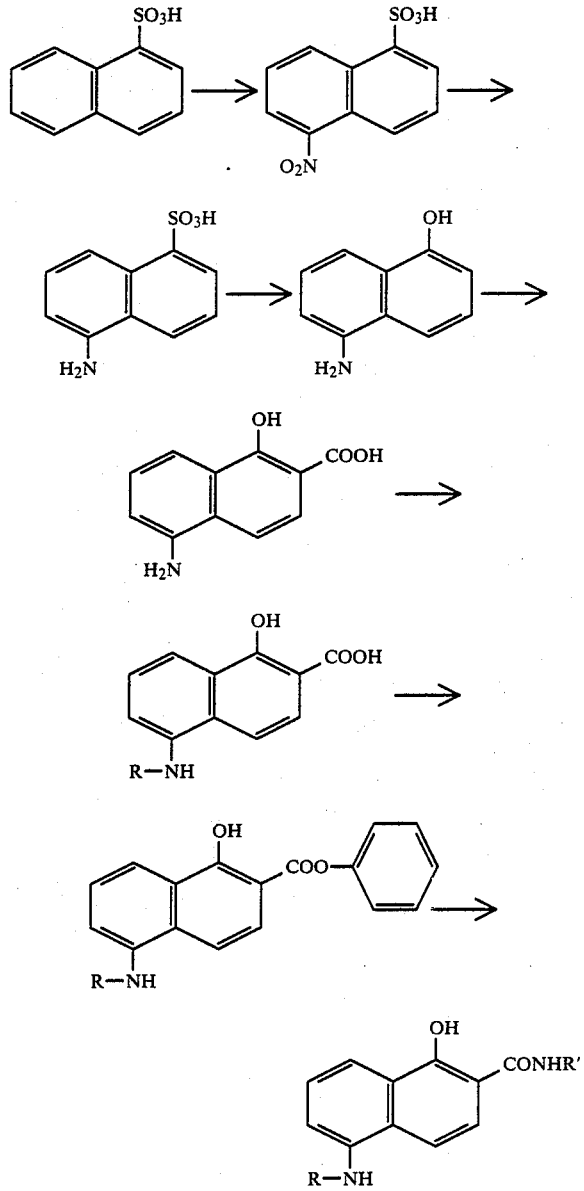

4-equivalent coupler wherein R represents a monovalent substituent, and R' represents an aliphatic or aromatic group.

Usual 1-Naphthol Coupler

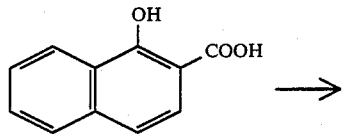

-continued

Usual 1-Naphthol Coupler

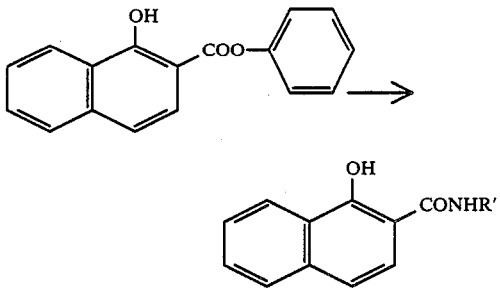

wherein R' represents an aliphatic or aromatic group.

It is apparent as illustrated above that the 5-position substituted type 1-naphthol-based couplers require more preparation steps than the usual 1-naphthol-based coupler and thus are of high preparation cost.

In addition, the 2-arylcarbamoyl-1-naphthol coupler and 5-position substituted type naphthol coupler have such disadvantages that they have a large sub-absorption in the shorter wavelength side, particularly in the blue light region, and this sub-absorption deteriorates the color reproduction of the light-sensitive material.

SUMMARY OF THE INVENTION

An object of the present invention is to provide a silver halide color photographic material which even when processed with a fatigued or low oxidation power bleaching solution or bleach-fixing solution, produces a color image which is free from a reduction in cyan color density.

Another object of the present invention is to provide a silver halide color photographic material which produces a cyan image excellent in fastness against heat, moisture and light.

Still another object of the present invention is to provide a silver halide color photographic material containing a cyan coupler which is inexpensive and is excellent in production suitability.

A further object of the present invention is to provide a silver halide color photographic material which is excellent in color reproduction.

These and other objects and advantages of the present invention will become apparent to those skilled in the art from a consideration of the following specification and claims.

In accordance with the present invention, a combination of a 1-naphthol-based coupler having a specified group in the 5-position and a 2-arylcarbamoyl-1-naphthol-based coupler is used as the cyan coupler. In another embodiment of the invention, a combination of a 1-naphthol-based coupler having a specified group in the 5-position, a 2-arylcarbamoyl-1-naphthol-based coupler and a compound which forms a diffusing development inhibitor or its precursor upon reaction with an oxidized product of a developing agent is used in the silver halide color photographic material of the invention. The latter combination provides excellent color reproduction in addition to the other objects noted above.

Accordingly, the present invention relates to a silver halide color photographic material comprising a support and at least one red-sensitive emulsion layer, at least one green-sensitive emulsion layer and at least one blue-sensitive emulsion layer on the support, which contains at least one cyan forming coupler represented by the general formula (I) and at least one cyan forming color represented by the general formula (II):

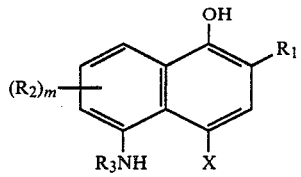

(I)

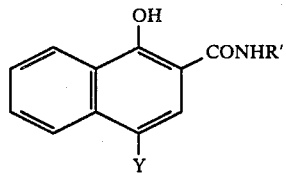

(II)

wherein $R_1$ represents $—CONR_5R_6$, $—NHCOR_5$, $—NHCOOR_7$, $—NHSO_2R_7$, $—NHCONR_5R_6$, or $—NHSO_2NR_5R_6$, $R_2$ represents a group which can be substituted in the naphthol ring, m represents 0 or an integer of 1 to $R_3$ represents a monovalent group, $R_4$ represents an aromatic group, and X and Y each represents a hydrogen atom or a group capable of leaving through a coupling reaction with an oxidized product of aromatic primary amine developing agent.

In the above formulae, $R_5$ and $R_6$ may be the same or different, and each represents a hydrogen atom, an aliphatic group, an aromatic group or a heterocyclic group, and $R_7$ represents an aliphatic group, an aromatic group or a heterocyclic group. The aliphatic group may be a straight, branched or cyclic alkyl, alkenyl or alkynyl group, and may be substituted or unsubstituted. The aromatic group may be a substituted or unsubstituted aryl group and may be a condensed ring. The heterocyclic group may be a substituted or unsubstituted, monocyclic or condensed heterocyclic group.

When m is plural, the $R_2$ groups may be the same or different, or may combine together to form a ring, $R_2$ and $R_3$, or $R_3$ and X may combine together to form a ring.

BRIEF DESCRIPTION OF THE DRAWING

The drawing illustrates a data processing method for testing the degree of color mixing of yellow associated with cyan color formation. Details are described in the last part of the description in Example 1.

DETAILED DESCRIPTION OF THE INVENTION

The substituents in the general formulae (I) and (II) will hereinafter be explained in detail.

$R_1$ represents $—CONR_5R_6$, $—NHCOR_5$, $—NHCOOR_7$, $—NHSO_2R_7$, $—NHCONR_5R_6$ or $—NHSO_2NR_5R_6$.

$R_5$ and $R_6$ each represents a hydrogen atom, an aliphatic group having 1 to 30 carbon atoms, an aromatic group having 6 to 30 carbon atoms, or a heterocyclic group having 2 to 30 carbon atoms. $R_7$ represents an aliphatic group having 1 to 30 carbon atoms, an aromatic group having 6 to 30 carbon atoms, or a heterocyclic group having 2 to 30 carbon atoms.

$R_2$ represents a group (including an atom; hereinafter all groups include atoms unless otherwise indicated) having from 0 to 30 carbon atoms, which can be substituted in the naphthol ring. Typical examples are a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, and an imido group. Therefore, $R_2$ may contain from 0 to 30 carbon atoms. When m is 2, $R_2$ may be cyclic; an example of a cyclic $R_2$ group is a dioxymethylene group.

$R_3$ represents a monovalent group and preferably is represented by the general formula (III):

$$R_8(Z)_n- \qquad \text{(III)}$$

wherein

Z represents $>NH$, $>CO$ or $>SO_2$, n represents 0 or 1, and $R_8$ represents a hydrogen atom, an aliphatic group having 1 to 30 carbon atoms, an aromatic group having 6 to 30 carbon atoms, a heterocyclic group having 1 to 30 carbon atoms, $—OR_9$, $—COR_9$,

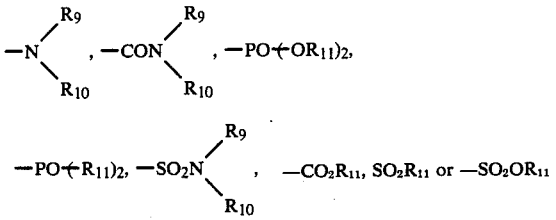

(wherein $R_9$, $R_{10}$ and $R_{11}$, respectively, represent the same groups as are represented by $R_5$, $R_6$ and $R_7$).

In the $R_1$ and $R_8$ groups, $R_5$ and $R_6$ in the

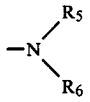

moiety, or $R_9$ and $R_{10}$ in the

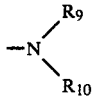

moiety, respectively, may combine together to form a nitrogen-containing heterocyclic group (e.g., a morpholine ring, a piperidine ring or a pyrrolidone ring).

$R_4$ represents an aromatic group having 6 to 30 carbon atoms which may be substituted in the aromatic ring with one or more replaceable group (including a replaceable atom; hereinafter all "replaceable" groups include replaceable atom unless otherwise indicated). Typical examples of these replaceable groups are a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, an ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, an aliphatic group, an aliphatic oxycarbonyl group and the like. When the aromatic ring is substituted with a plurality of groups, the groups may combine together to form a ring. An example of such a ring is a dioxymethylene group.

X and Y each represents a hydrogen atom or a coupling-off group (including a coupling-off atom; hereinafter all coupling-off groups include coupling-off atoms unless otherwise indicated). Typical examples of such coupling-off groups are a halogen atom, $—OR_{12}$, $—SR_{12}$, $$—\underset{\underset{O}{\|}}{C}OR_{12},$$

$—NHCOR_{12}$, $$—\underset{\underset{O}{\|}}{NHCS}R_{12},\ —\underset{\underset{O}{\|}}{OC}—OR_{12},\ —\underset{\underset{O}{\|}}{OCNH}R_{12},$$

an aromatic azo groups having 6 to 30 carbon atoms, a heterocyclic group having 1 to 30 carbon atoms and linked through a nitrogen atom to the coupling active position of the coupler (e.g., a succinic acid imido group, a phthalamido group, a hydantoinyl group, a pyrazolyl group and a 2-benzotriazolyl group), and the like. $R_{12}$ represents an aliphatic group having 1 to 30 carbon atoms, an aromatic group having 6 to 30 carbon atoms or a heterocyclic group having 2 to 30 carbon atoms.

In the present invention, the aliphatic group may be saturated or unsaturated, substituted or unsubstituted, or straight, branched or cyclic. Typical examples of the aliphatic group are methyl, ethyl, butyl, cyclohexyl, allyl, propargyl, methoxyethyl, n-dodecyl, n-hexadecyl, trifluoromethyl, heptafluoropropyl, dodecyloxypropyl, 2,4-di-tert-amylphenoxypropyl and 2,4-di-tert-amylphenoxybutyl.

The aromatic group may be substituted or unsubstituted. Typical examples are phenyl, tolyl, 2-tetradecyloxyphenyl, pentafluorophenyl, 2-chloro-5-dodecyloxycarbonylphenyl, 4-chlorophenyl, 4-cyanophenyl, and 4-hydroxyphenyl.

The heterocyclic group may be substituted or unsubstituted. Typical examples of the heterocyclic group are 2-pyridyl, 4-pyridyl, 2-furyl, 4-thienyl, and quinolyl.

Substituents which are preferred in the present invention are described below.

$R_1$ is preferably $—CONR_5R_6$. Specific examples are a carbamoyl group, an ethylcarbamoyl group, a morpholinocarbonyl group, a dodecylcarbamoyl group, a hexadecylcarbamoyl group, a decyloxypropyl group, a dodecyloxypropyl group, a 2,4-di-tert-amylphenoxypropyl group, and a 2,4-di-tert-amylphenoxybutyl group.

In connection with $R_2$ and m, it is most preferred that m is 0, that is, there is no $R_2$ group. If present, it is preferred that $R_2$ be a halogen atom, an aliphatic group, a carbonamido group or a sulfonamido group.

With respect to $R_3$, it is preferred that in the general formula (III), n is 0, and $R_8$ is $—COR_9$ (e.g., a formyl group, an acetyl group, a trifluoroacetyl group, a chloroacetyl group, a benzoyl group, a pentafluorobenzoyl group or a p-chlorobenzyl group), $—CO_2R_{11}$ (e.g., a methoxycarbonyl group, an ethoxycarbonyl group, a butoxycarbonyl group, a decyloxycarbonyl group, a methoxyethoxycarbonyl group or a phenoxycarbonyl group), $—SO_2R_{11}$ (e.g., a methanesulfonyl group, an ethanesulfonyl group, a butanesulfonyl group, a hexadecanesulfonyl group, a benzenesulfonyl group, a toluenesulfonyl group or a p-chlorobenzenesulfonyl group), $—CONR_9R_{10}$ (e.g., an N,N-dimethylcarbamoyl group, and N,N-diethylcarbamoyl group, an N,N-dibutylcarbamoyl group, a morpholinocarbonyl group, a piperidinocarbonyl group, a 4-cyanophenylcarbonyl group, a 3,4-dichlorophenylcarbamoyl group or a 4-methanesulfonylphenylcarbamoyl group), or $—SO_2NR_9R_{10}$ (e.g., an N,N-dimethylsulfamoyl group, an N,N-diethylsulfamoyl group or an N,N-dipropylsulfamoyl group). Particularly preferred $R_8$ groups are $—CO_2R_{11}$, $—COR_9$ and $—SO_2R_{11}$. Of these groups, $—CO_2R_{11}$ is especially preferred.

$R_4$ is preferably a naphthyl group, or a phenyl group having an aliphatic oxy group or a halogen atom in the 2-position thereof (e.g., a 2-chlorophenyl group, a 2-ethoxyphenyl group, a 2-propyloxyphenyl group, a 2-butyloxyphenyl group, a 2-dodecyloxyphenyl group, a 2-tetradecyloxyphenyl group, a 2-(2-hexyldecyloxy)-phenyl group or a 2-chloro-5-dodecyloxycarbonylphenyl group).

X and Y are each preferably a hydrogen atom, a chlorine atom, an aliphatic oxy group (e.g., a 2-hydroxyethoxy group, a 2-chloroethoxy group, a carboxymethyloxy group, a 1-carboxyethoxy group, a 2-methanesulfonylethoxy group, a 3-carboxypropyloxy group, a 2-methoxyethoxycarbamoylmethyloxy group, a 1-carboxytridecyl group, a 2-(1-carboxytridecylthio)ethyloxy group, a 2-carboxymethylthioethyloxy group or a 2-methanesulfonamidoethyloxy group), an aromatic oxy group (e.g., a 4-acetoamidophenoxy group, a 2-acetoamidophenoxy group or a 4-(3-carboxypropaneamido)phenoxy group) or a carbamoyloxy group (e.g., an ethylcarbamoyloxy group or a phenylcarbamoyloxy group).

In the coupler represented by the general formula (I), the substituent $R_1$, $R_2$, $R_3$ or X may combine through a divalent group or a group having a valency of three of more to form a dimer or a polymer having a degree of polymerization of 3 or more. In the coupler represented by the general formula (II), the substituent $R_4$ or Y may combine through a divalent group or a group having a valency of three of more to form a dimer or a polymer having a degree of polymerization of 3 or more. In these cases, the number of carbon atoms in each substituent may fall outside the above-specified ranges.

In the cases where the couplers represented by the general formula (I) or (II) form polymers, such polymer couplers typically include homopolymers or copolymers of addition polymerizable ethylenically unsaturated compounds having a cyan dye forming coupler residue (hereinafter referred to as cyan forming monomers). Such homo- or copolymers contain a repeating unit represented by the following general formula (IV). The polymers may contain one or more kinds of the repeating units of the general formula (IV), and also may be copolymers containing one or more of non-color forming ethylenically unsaturated monomers as comonomers:

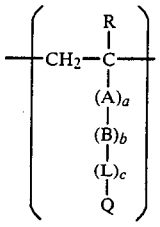

(IV)

wherein

R represents a hydrogen atom, an alkyl group having 1 to 4 carbon atoms, or a chlorine atom, A represents —CONH—, —COO—, or a substituted or unsubstituted phenylene group, B represents a substituted or unsubstituted alkylene group, a phenylene group, or an aralkylene group, L represents —CONH—, —NHCONH—, —NHCOO—, —NHCO—, —OCONH—, —NH—, —COO—, —OCO—, —CO—, —O—, —S—, $—SO_2—$, $—NHSO_2—$, or $—SO_2NH—$, a, b and c each represents 0 or 1, and Q represents a cyan coupler residue resulting from removal of a hydrogen atom other than the hydrogen atom of the hydroxyl group in the 1-position from the coupler represented by the general formula (I) or (II).

The polymer coupler is preferably, a copolymer which contains one or more of said cyan color forming repeating units and one or more non-color forming ethylenically unsaturated monomers.

The preferred polymer coupler is a copolymer of a cyan color forming monomer providing the coupler unit of the general formula (IV) and a non-color forming ethylenically unsaturated monomer as described below.

Examples of non-color forming ethylenically unsaturated monomers which do not couple with an oxidized product of an aromatic primary amine developing agent are acrylic acid, α-chloroacrylic acid, α-alkylacrylic acid (e.g., methacrylic acid), esters or amides derived from the above acids (e.g., acrylamide, methacrylamide, n-butylacrylamide, tert-butylacrylamide, diacetoneacrylamide, methyl acrylate, ethyl acrylate n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (e.g., vinyl acetate, vinyl propionate and vinyl laurate), acrylonitrile, methacrylonitrile, aromatic vinyl compounds (e.g., styrene and its derivatives such as vinyltoluene, divinylbenzene, vinylacetophenone and sulfostyrene), itaconic acid, citraconic cid, chrotonic acid, vinylidene chloride, vinyl alkyl ethers (e.g., vinyl ethyl ether), maleic acid esters, N-vinyl-2-pyrrolidone, N-vinylpyridine and 2- and 4-vinylpyridine.

Particularly preferred are acrylic acid esters, methacrylic acid esters and maleic acid esters. Two or more of the non-color forming ethylenically unsaturated monomers can be used in combination. For example, mixtures of methyl acrylate and butyl acrylate, butyl acrylate and styrene, butyl methacrylate and methacrylic acid, and of methyl acrylate and diacetone acrylamide can be used.

As is well known in the field of polymer couplers, the ethylenically unsaturated monomer to be copolymerized with the vinyl monomer corresponding to the general formula (IV) can be selected so as to exert a good influence on the physical and/or chemical properties of the formed copolymer, such as solubility, compatibility with a binder (e.g., gelatin) of the photographic colloid composition, flexibility and thermal stability.

An emulsified dispersion of a cyan polymeric coupler to be used in the present invention can be prepared as follows. A lipophilic polymer coupler obtained by polymerization of a vinyl monomer which provides the coupler unit of the general formula (IV) is dissolved in an organic solvent. By emulsifying and dispersing the above prepared solution in an aqueous gelatin solution in the form of latex, the emulsified dispersion can be prepared. Alternatively, the emulsified dispersion may be prepared by the direct emulsion polymerization method.

For emulsification and dispersion of the lipophilic polymer coupler in an aqueous gelatin solution in the form of latex, the method described in U.S. Pat. No. 3,451,820 can be used, and for the emulsion polymerization, the methods described in U.S. Pat. Nos. 4,080,211 and 3,370,952 can be used.

Specific examples of the couplers represented by the general formulae (I) and (II) are shown below, although the present invention is not limited thereto. In the following formulae, $(t)C_5H_{11}$ and $(t)C_8H_{17}$ represent, respectively, $-C(CH_3)_2C_2H_5$ and $-C(CH_3)_2CH_2C(CH_3)_3$.

Specific examples of the couplers represented by the general formula (I) are shown below.

(I-1)

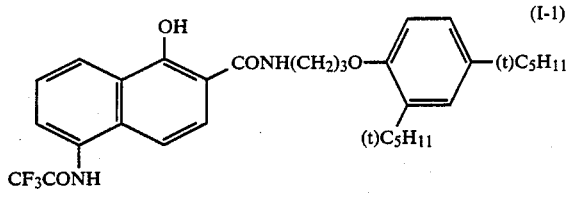

(I-2)

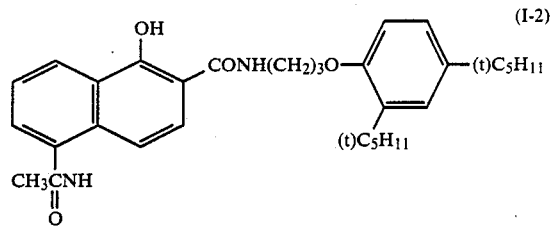

(I-3)

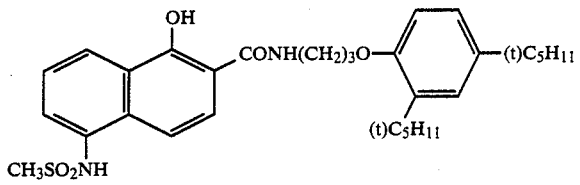

(I-4)

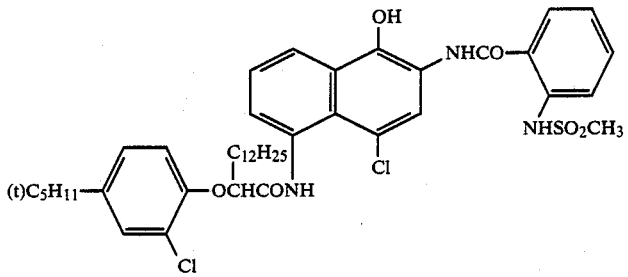

(I-5)

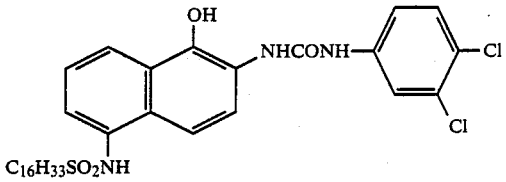

(I-6)

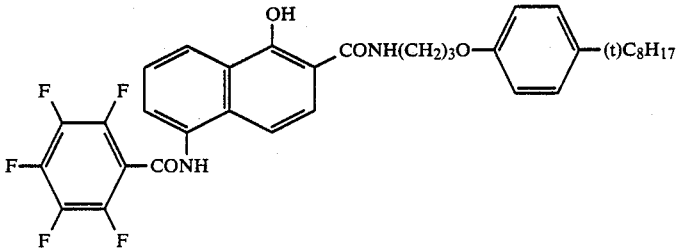

-continued
(I-7)
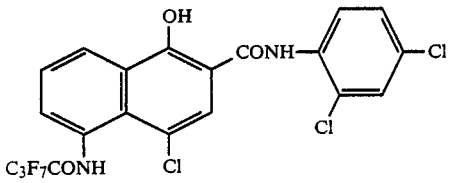
(I-8)
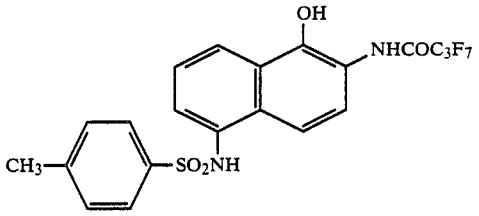
(I-9)
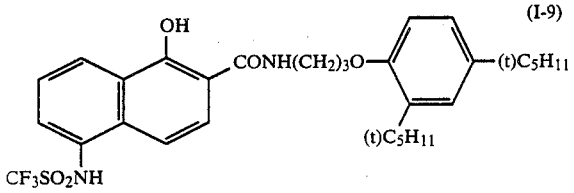
(I-10)
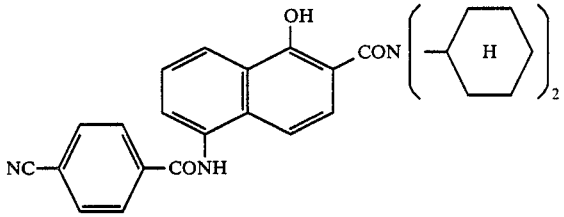
(I-11)
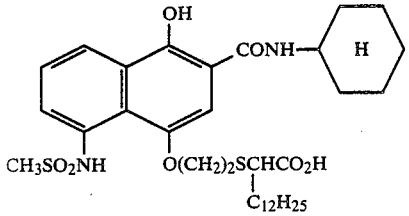
(I-12)
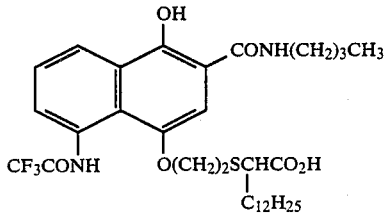
(I-13)
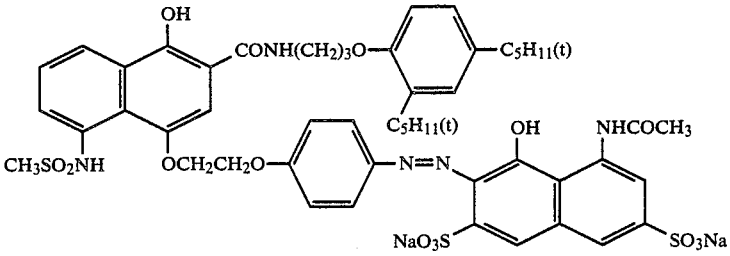
(I-14)
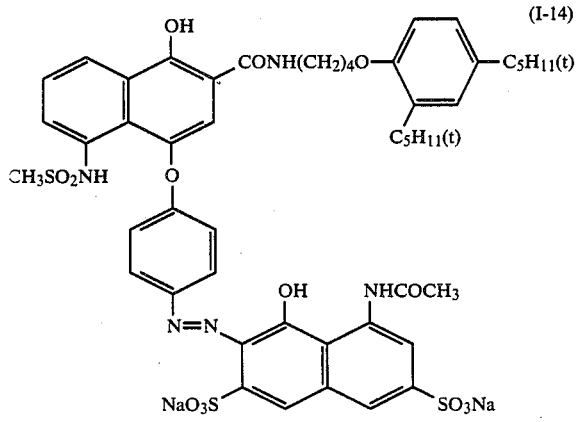
(I-15)
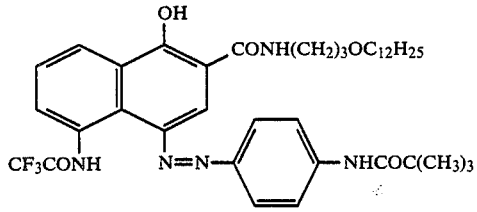

-continued
(I-16)
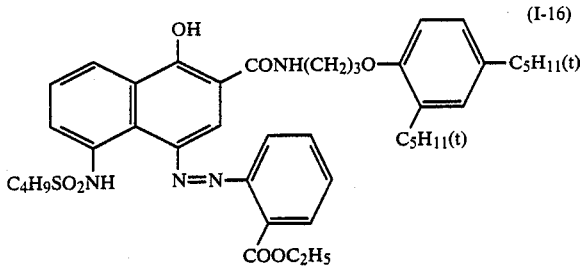
(I-17)
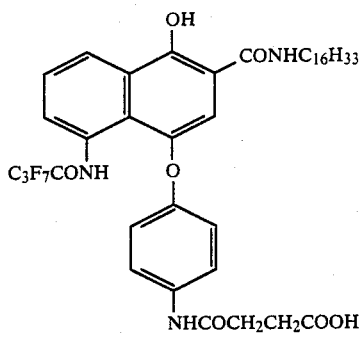
(I-18)
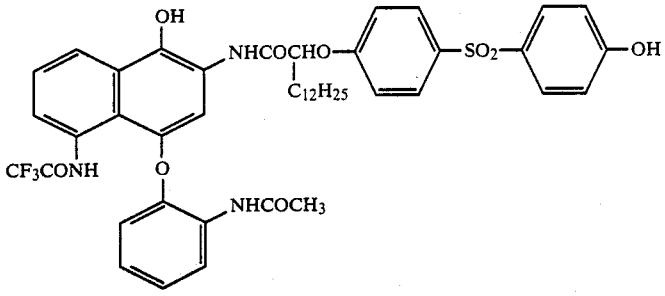
(I-19)
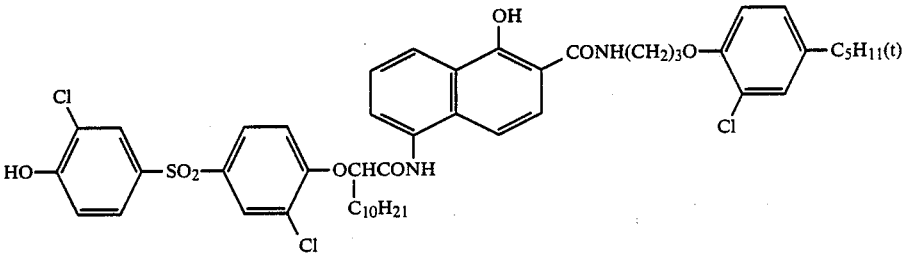
(I-20)
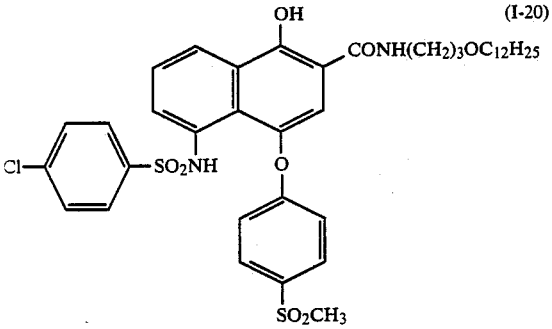
(I-21)
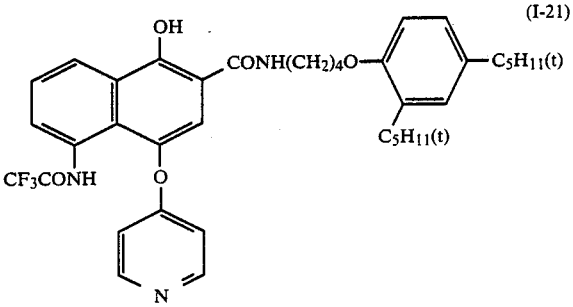
(I-22)
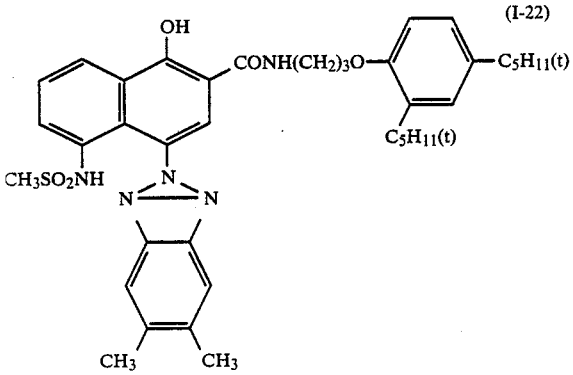
(I-23)
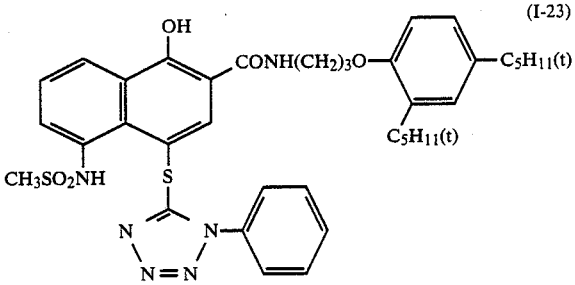

-continued
(I-24)
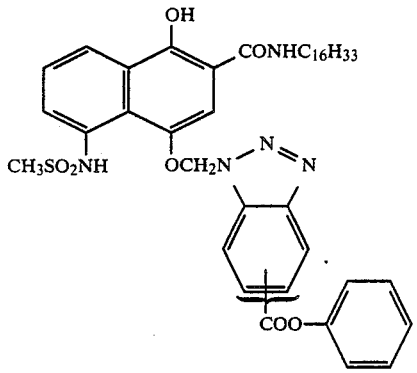
(I-25)
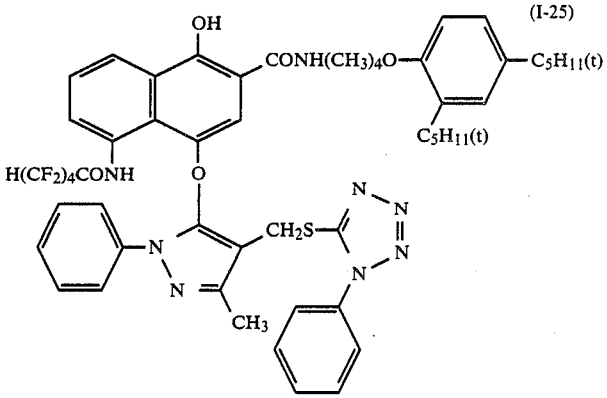
(I-26)
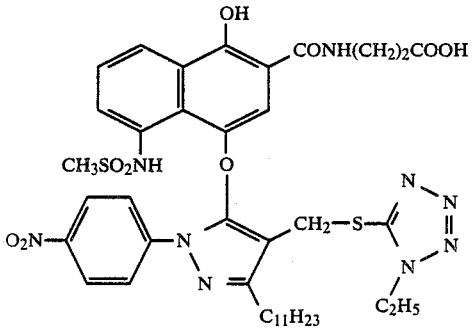
(I-27)
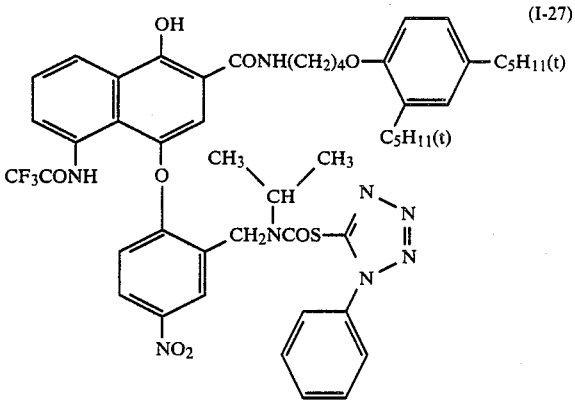
(I-28)
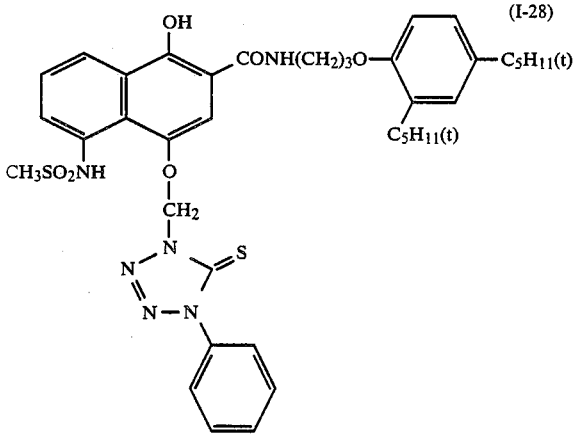
(I-29)
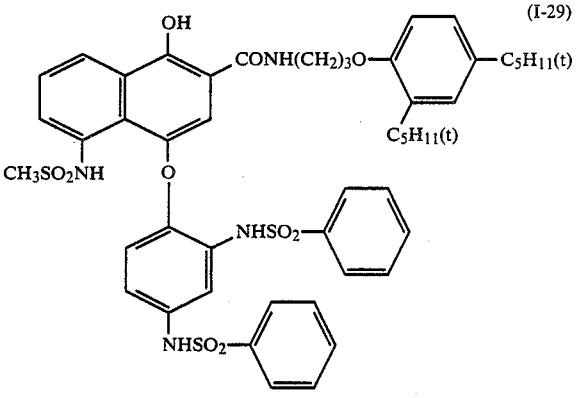
(I-30)
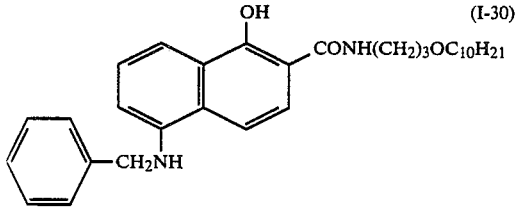
(I-31)
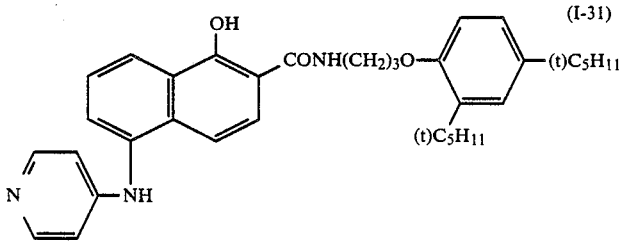

-continued
(I-32)
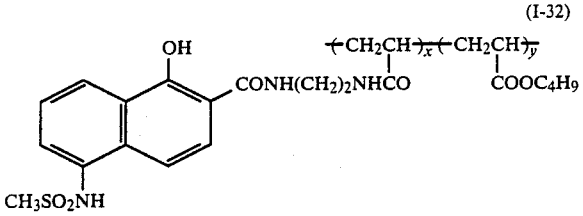
x:y = 70:30
(molar ratio)
(I-33)
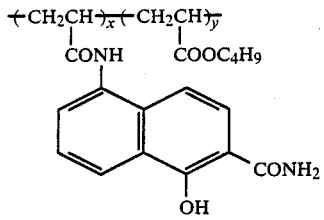
x:y = 50:50
(molar ratio)
(I-34)
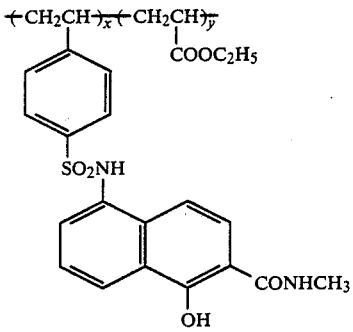
x:y = 60:40
(molar ratio)
(I-35)
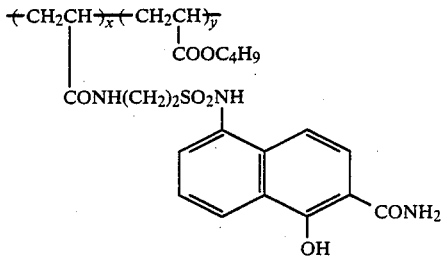
x:y = 80:20
(molar ratio)
(I-36)
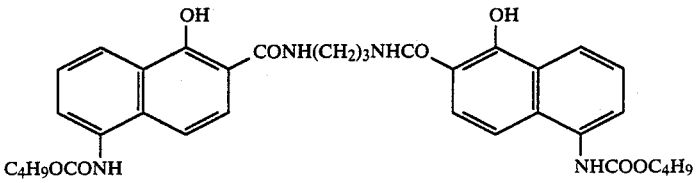
Representative examples of the couplers represented by the general formula (II) are shown below.
(II-1)
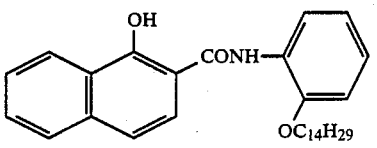
(II-2)
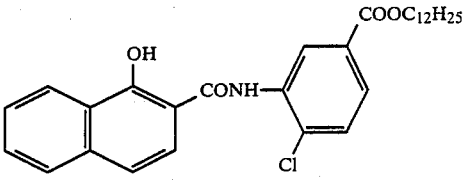
(II-3)
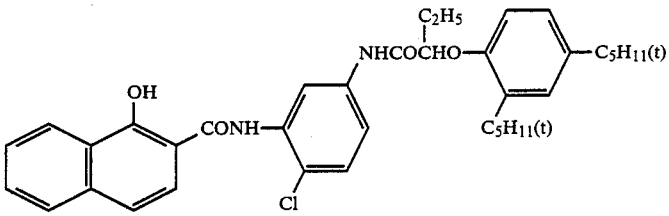
(II-4)
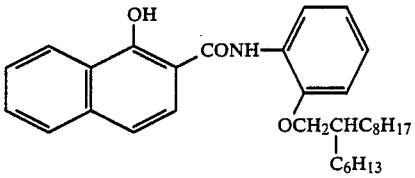
(II-5)
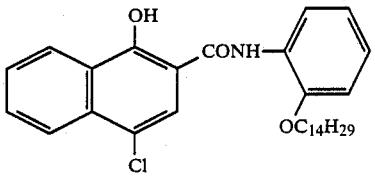

-continued
(II-6)
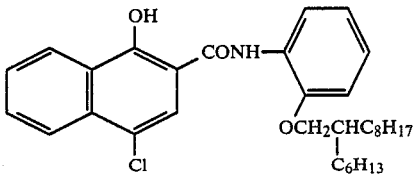
(II-7)
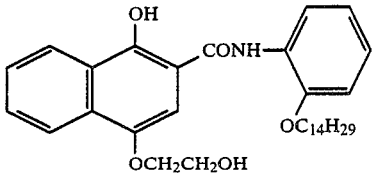
(II-8)
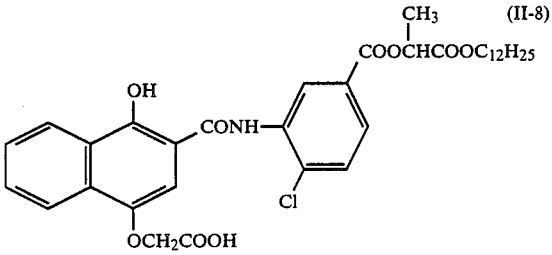
(II-9)
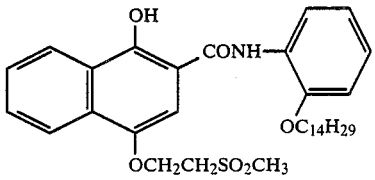
(II-10)
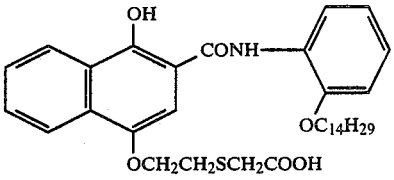
(II-11)
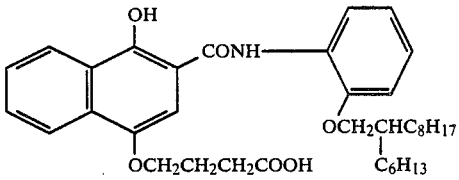
(II-12)
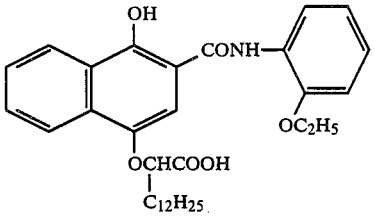
(II-13)
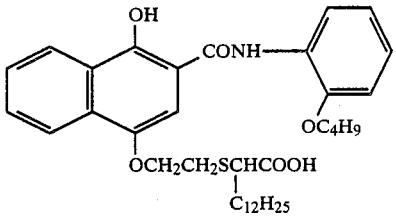
(II-14)
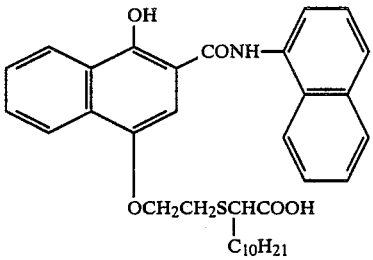
(II-15)
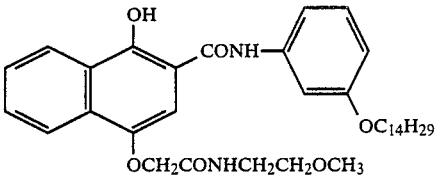
(II-16)
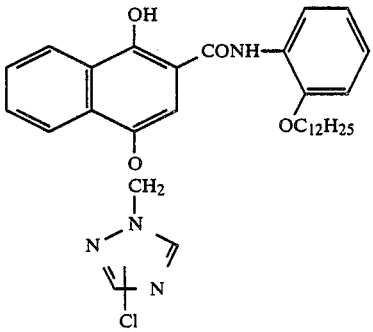
(II-17)
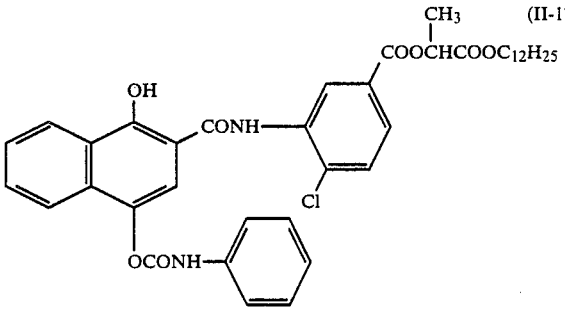

-continued
(II-18)
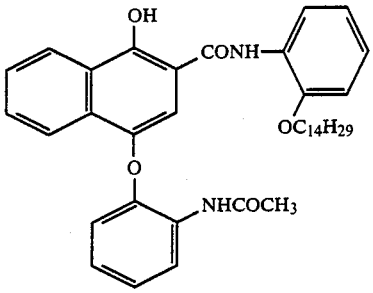
(II-19)
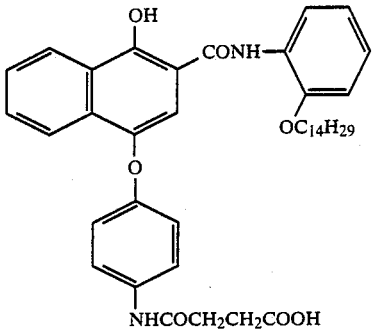
(II-20)
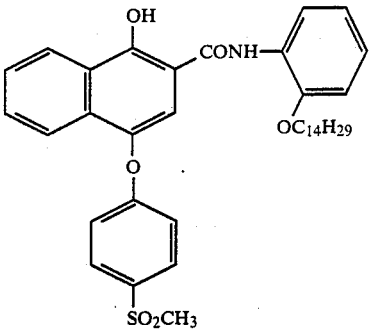
(II-21)
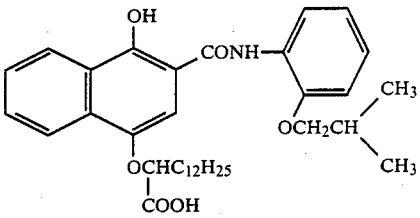
(II-22)
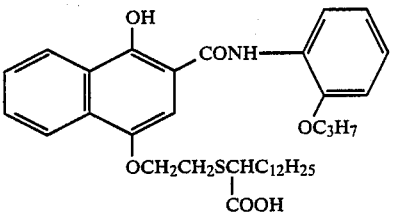
(II-23)
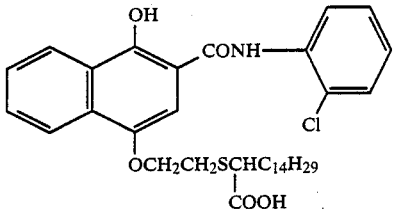
(II-24)
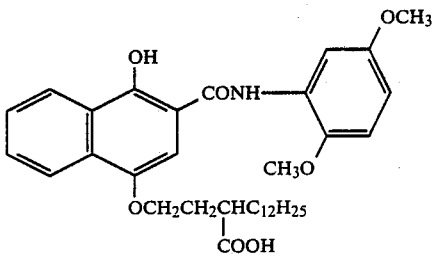
(II-25)
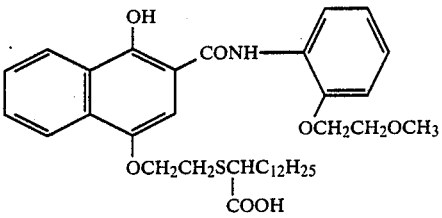
(II-26)
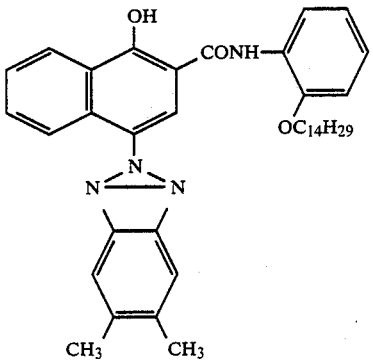
(II-27)
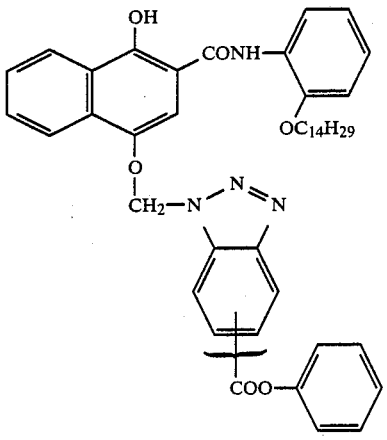

-continued
(II-28)
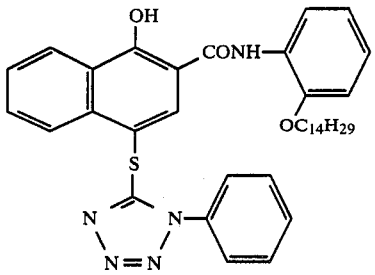
(II-29)
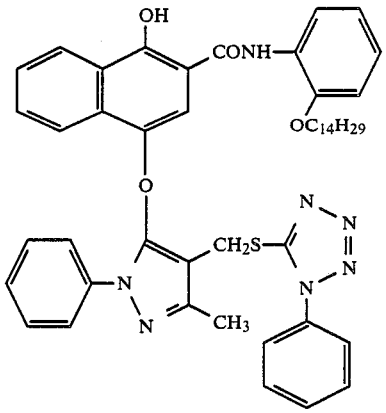
(II-30)
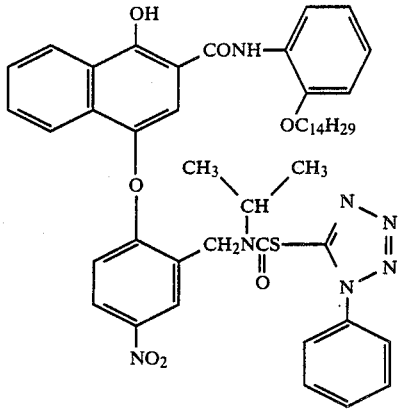
(II-31)
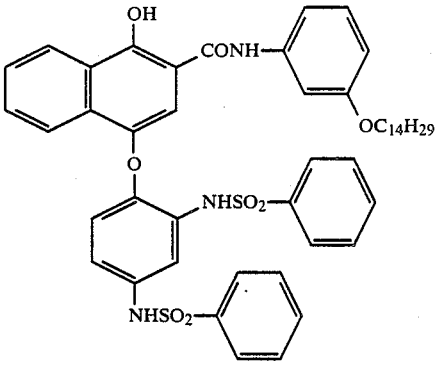
(II-32)
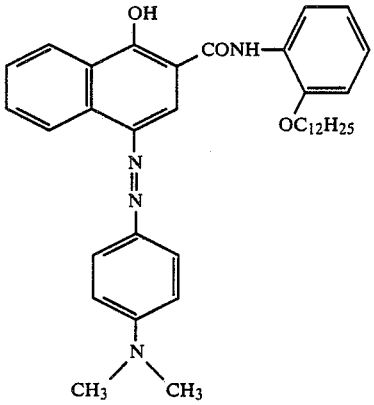
(II-33)
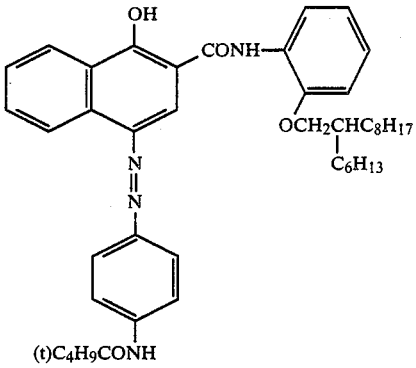
(II-34)
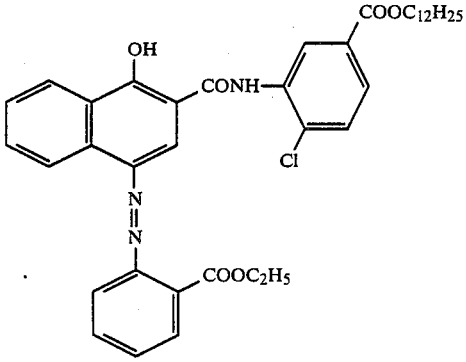
(II-35)
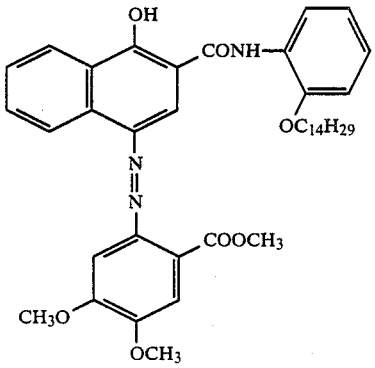

-continued (II-36)

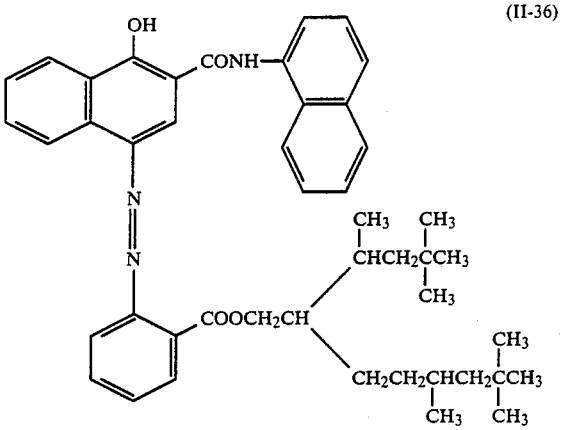

In the above formulae and the following formulae,

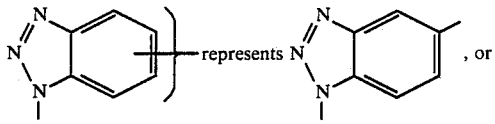

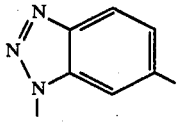

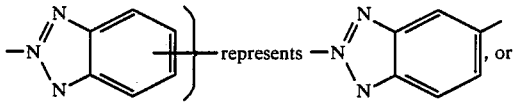

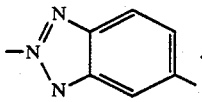

The couplers of the general formula (I) can be prepared by the methods described in European Patent No. 161,626A2.

The couplers of the general formula (II) can be prepared by the methods described in U.S. Pat. No. 3,488,193, and in Japanese Patent Application (OPI) Nos. 15529/73, 117422/75, 18315/77, 90932/77, 52423/78, 48237/79, 66129/79, 32071/80, 65957/80, 105226/80, 1938/81, 12643/81, 27147/81, 126832/81 and 95346/83 (the term "OPI" as used herein refers to a "published unexamined Japanese patent application").

As the coupling-off group of the compounds of the general formula (II), groups other than an arylazo group or substituents containing an arylazo moiety are preferred.

In the present invention, it is preferred that DIR compounds be used in combination with said couplers in order to compensate for unnecessary yellow and magenta absorption of color forming dyes derived from the couplers of the general formulae (I) and (II). DIR compounds are compounds which form a development inhibitor upon chemical reaction with an oxidized product of a color developing agent. Examples are DIR hydroquinones and DIR couplers. Use of such DIR couplers in combination is preferred over the use of DIR hydroquinone in combination. Compounds which release a diffusible development inhibitor upon chemical reaction with a color developing agent are hereinafter called "diffusible DIR compounds".

Diffusible DIR compounds which are preferably used in combination in the present invention are compounds capable of forming a highly diffusible development inhibitor at the time of development. In the present invention, DIR compounds capable of releasing a development inhibitor having a high diffusibility are employed. Preferred are compounds that display a degree of diffusion of not less than 0.4. The measuring method and exemplary diffusible DIR compounds of this type are described in European Patent No. 101,621. Of the DIR compounds, DIR couplers, particularly non-color forming or cyan color forming DIR couplers, are preferred. Such DIR couplers are represented by the general formula (V):

$$A\text{-}(Y')_m \qquad (V)$$

wherein A represents a coupler component, m represents 1 or 2, and Y' represents a group linked to the coupler component A at the coupling position thereof and released through reaction with an oxidized color developing agent, and represents a development inhibitor having a high diffusibility or a compound capable of releasing a development inhibitor.

In the general formula (V), Y' represents the following general formulae (VI) to (XI).

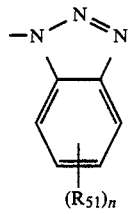

(VI)

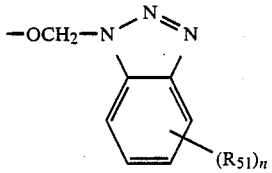

(VII)

-continued (VIII)

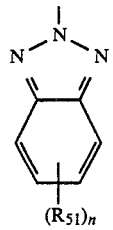

(IX)

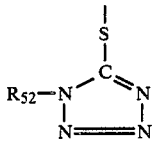

(X)

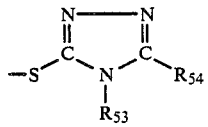

(XI)

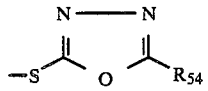

In the general formulae (VI), (VII) and (VIII), $R_{51}$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyl group, a hydroxyl group, an alkoxycarbonylamino group, an alkylthio group, an arylthio group, an aryl group, a heterocyclic group, a cyano group, an alkylsulfonyl group or an aryloxycarbonylamino group.

In the general formulae (VI), (VII) and (VIII), n represents 1 or 2. When n is 2, the $R_{51}$ groups may be the same or different. The total number of carbon atoms contained in the $R_{51}$ groups may be from 0 to 10.

In the general formula (IX), $R_{52}$ represents an alkyl group, an aryl group or a heterocyclic group.

In the general formula (X), $R_{53}$ represents a hydrogen atom, an alkyl group, an aryl group or a heterocyclic group, and, in the general formulae (X) and (XI), $R_{54}$ represents a hydrogen atom, an alkyl group, an aryl group, a halogen atom, an acylamino group, an alkoxycarbonylamino group, an aryloxycarbonylamino group, an alkanesulfonamido group, a cyano group, a heterocyclic group, an alkylthio group or an amino group. When $R_{51}$, $R_{52}$, $R_{53}$ or $R_{54}$ represents an alkyl group, the alkyl group may be substituted or unsubstituted, chain-like or cyclic. The substituent may be a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxyl group, an alkanesulfonyl group, an arylsulfonyl group, an alkylthio group or an arylthio group.

When $R_{51}$, $R_{52}$, $R_{53}$ or $R_{54}$ represents an aryl group, the aryl group may be substituted. The substituent may be an alkyl group, an alkenyl group, an alkoxy group, an alkoxycarbonyl group, a halogen atom, a nitro group, an amino group, a sulfamoyl group, a hydroxyl group, a carbamoyl group, an aryloxycarbonylamino group, an alkoxycarbonylamino group, an acylamino group, a cyano group or a ureido group.

When $R_{51}$, $R_{52}$, $R_{53}$ or $R_{54}$ represents a heterocyclic group, the heterocyclic group includes 5- or 6-membered monocyclic or condensed rings containing a nitrogen atom, an oxygen atom or a sulfur atom as the hetero atom. Examples are a pyridyl group, a quinolyl group, a furyl group, a benzothiazolyl group, an oxazolyl group, an imidazolyl group, a thiazolyl group, a triazolyl group, a benzotriazolyl group, an imido group, an oxazine group and the like. The heterocyclic group may be substituted with the same groups as the substituents listed above for the aryl group.

In the general formula (VIII), the number of carbon atoms contained in the $R_{52}$ groups may be from 1 to 15.

In the general formulae (X), the total number of carbon atoms contained in the $R_{53}$ and $R_{54}$ groups is from 1 to 15.

In the general formula (V), Y' can be represented by the general formula (XII):

-TIME-INHIBIT (XII)

wherein the TIME group is a group linked to the coupler at the coupling position thereof and capable of cleaving through reaction with a color developing agent, and is group capable of properly releasing the INHIBIT group after the cleavage from the coupler. The INHIBIT group is a development inhibitor.

In the above formula, the -TIME-INHIBIT group is preferably represented by the general formulae (VII) to (XIII) as described in European Patent No. 101,621.

Of the above diffusible DIR compounds, those compounds having a coupling-off group as represented by the general formulae (VI) to (XI) are particularly preferred.

Examples of the yellow color image-forming coupler residue represented by A are the pivaloylacetoanilide-type, benzoylacetoanilide-type, malonic diester-type, malonic diamido-type, dibenzoylmethane-type, benzothiazolylacetoamido-type, malonic estermonoamido-type, benzothiazolylacetate-type, benzoxazolylacetoamido-type, benzoxazolylacetate-type, malonic diester-type, benzimidazolylacetoamido-type or benzimidazolylacetate-type coupler residues, coupler residues derived from heterocyclic group-substituted acetamido or heterocyclic group-substituted acetates as described in U.S. Pat. No. 3,841,880, coupler residues derived from acylacetamides as described in U.S. Pat. No. 3,770,446, British Pat. No. 1,459,171, West German Patent Application (OLS) No. 2,503,099, Japanese Patent Application (OPI) No. 139738/75 and *Research Disclosure,* RD No. 15737, and heterocyclic type coupler residues as described in U.S. Pat. No. 4,046,574.

As the magenta color image-forming coupler residues represented by A, coupler residues having a 5-oxo-2-pyrazoline nucleus, a pirazolo-[1,5-a]benzimidazole nucleus or a cyanoacetophenone type coupler residue are preferred.

As the cyan color image-forming coupler residues represented by A, coupler residues having a phenol nucleus or an $\alpha$-naphthol nucleus are preferred.

In the general formula (V), A is preferably represented by the general formula (IA), (IIA), (IIIA), (IVA), (VA), (VIA), (VIIA), (VIIIA) or (IXA) as described in European Patent No. 101,621.

Representative examples of diffusible DIR couplers are shown below.
D-1
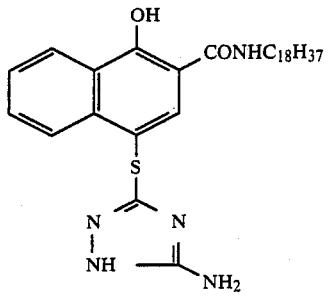
D-2
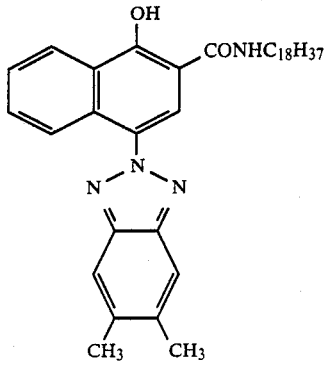
D-3
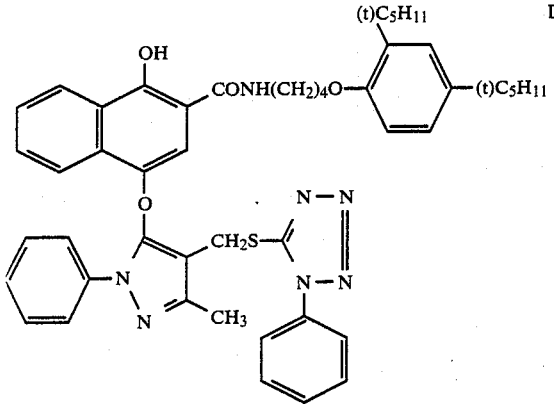
D-4
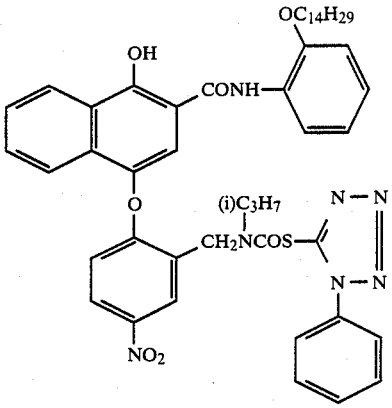
D-5
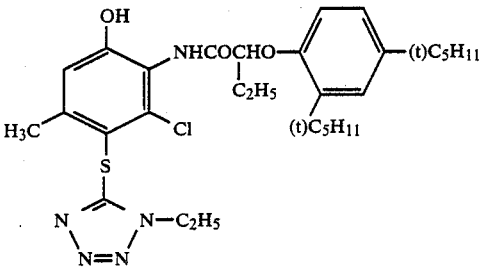
D-6
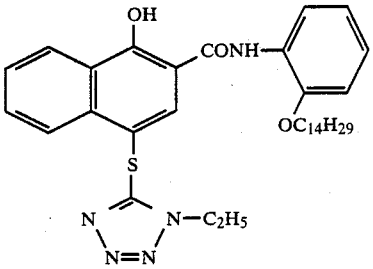
D-7
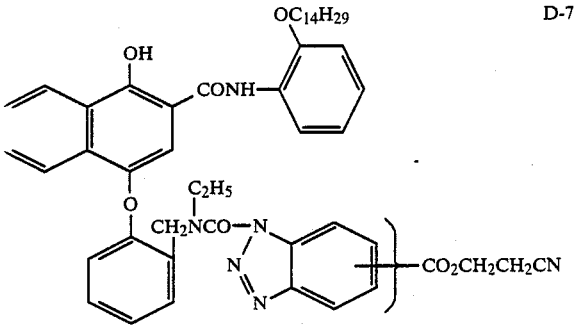
D-8
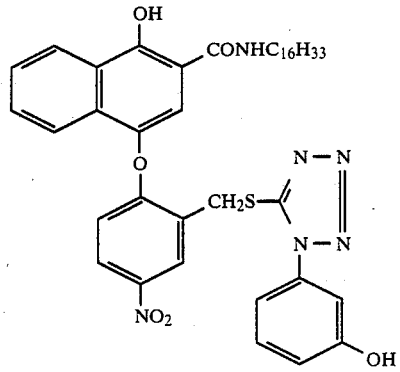

-continued
D-9
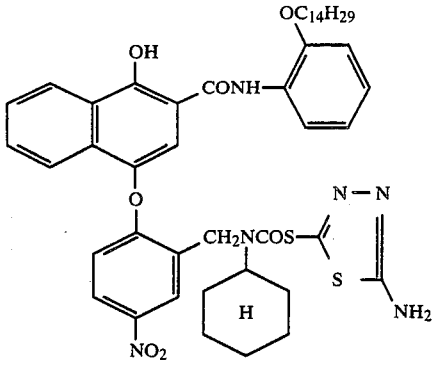
D-10
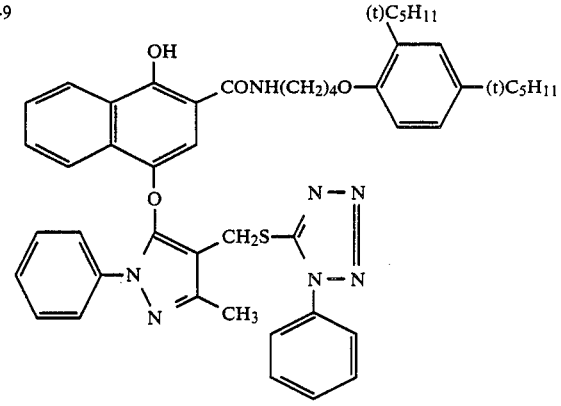
D-11
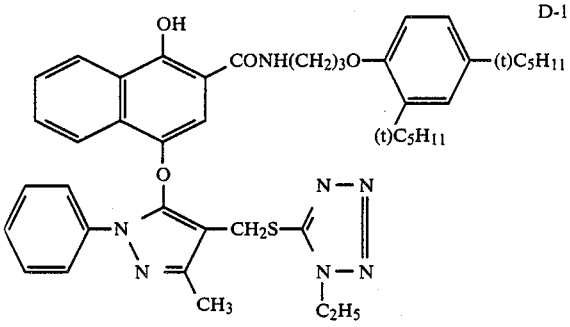
D-12
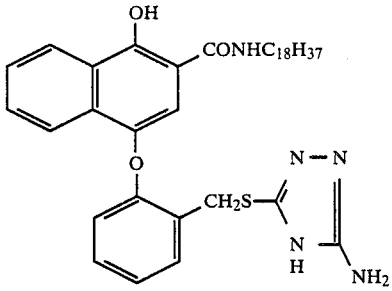
D-13
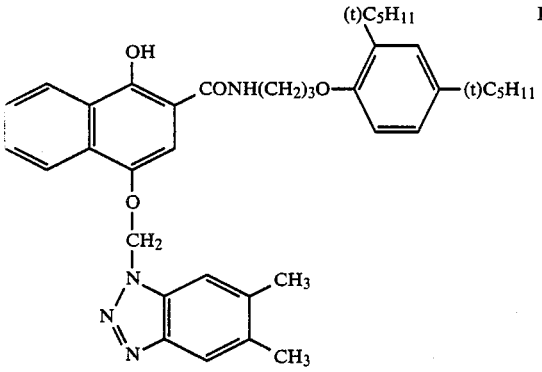
D-14
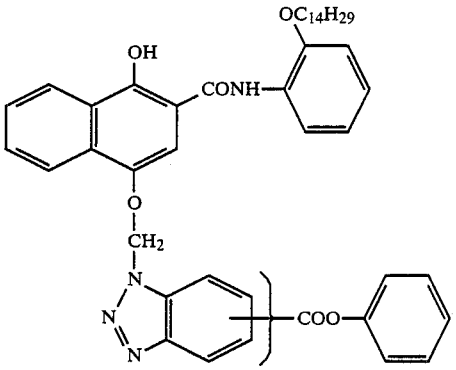
D-15
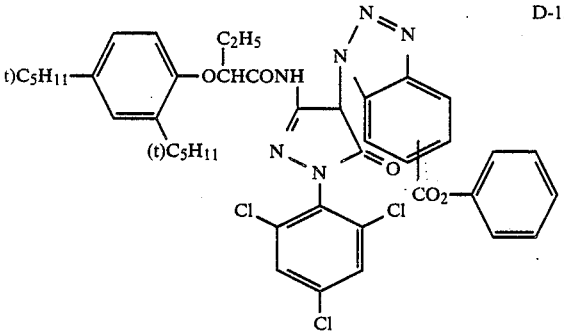
D-16
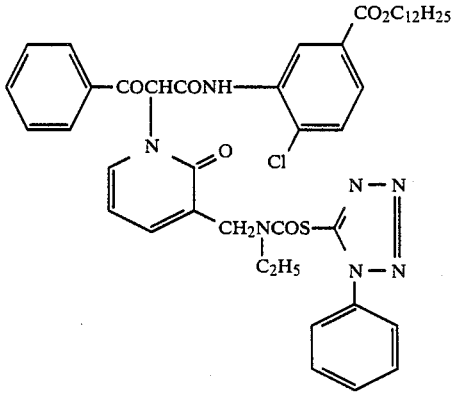

-continued
D-17
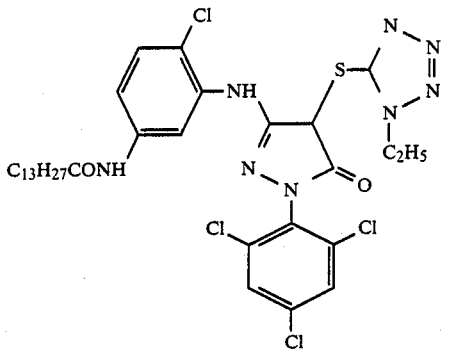
D-18
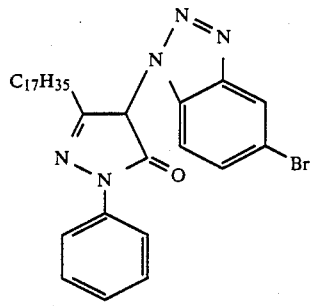
D-19
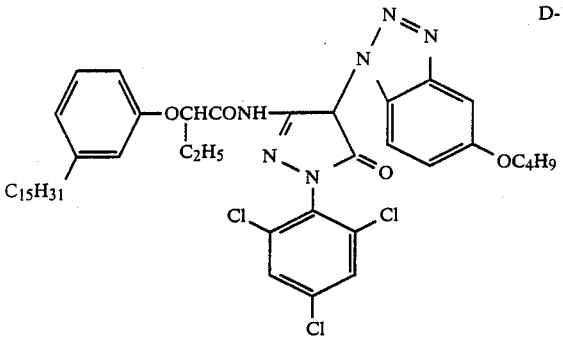
D-20
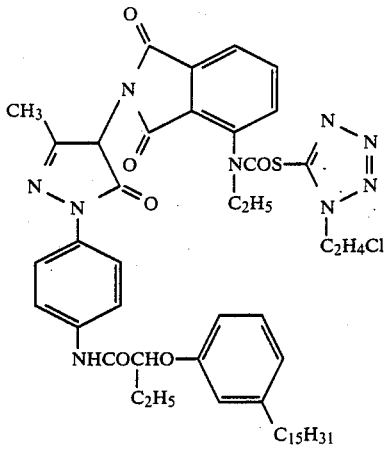
D-21
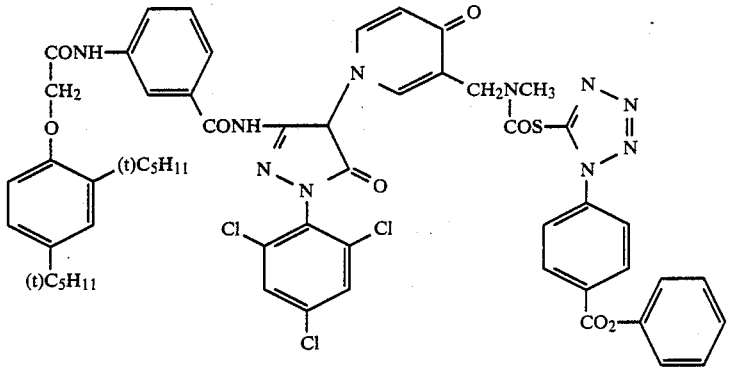
D-22
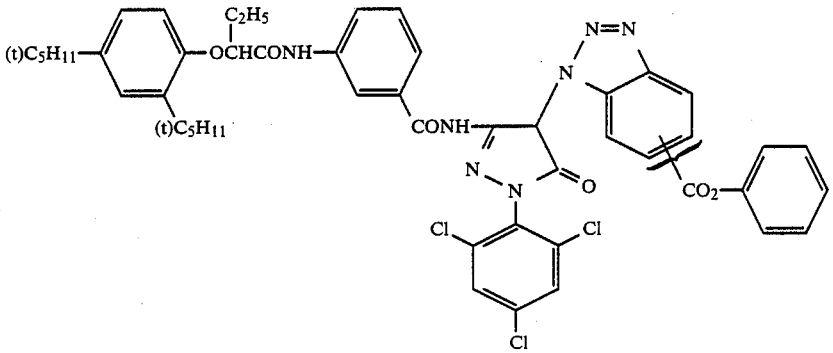

-continued
D-23
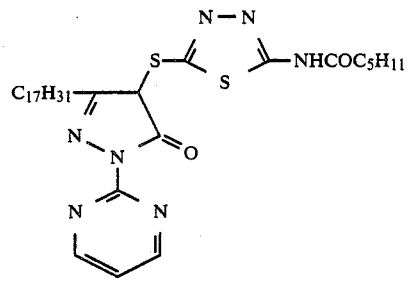
D-24
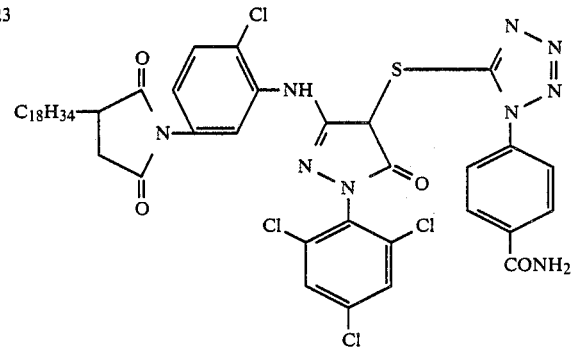
D-25
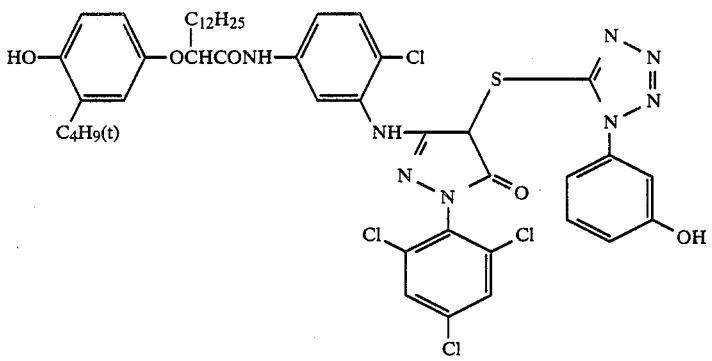
D-26
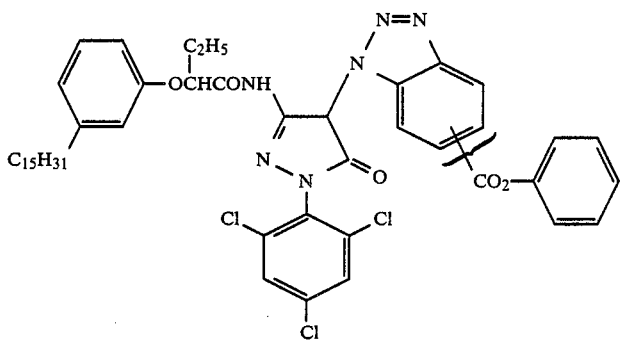
D-27
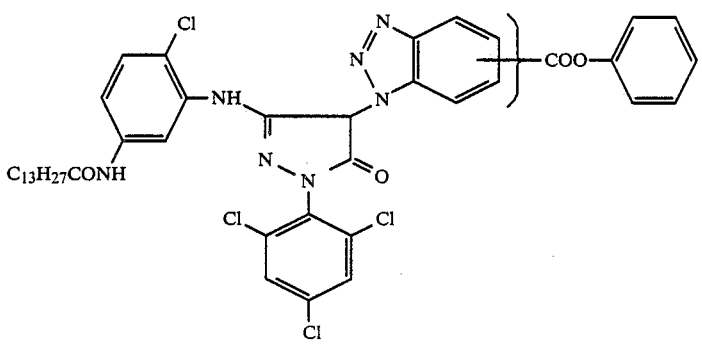

-continued
D-28
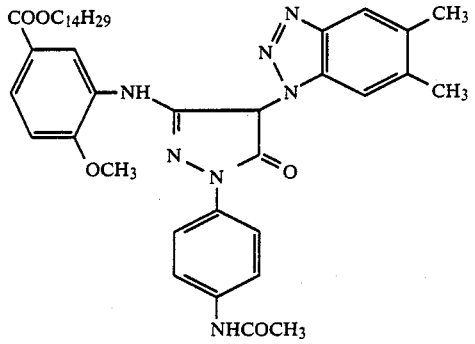
D-29
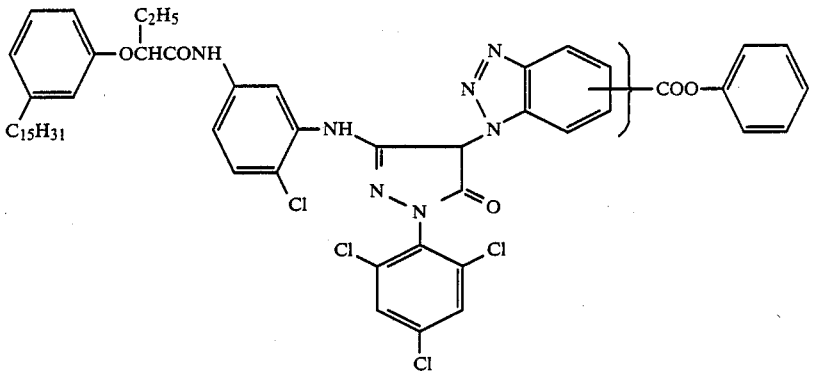
D-30
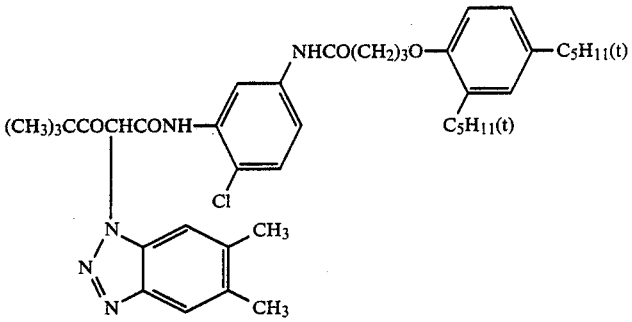
D-31
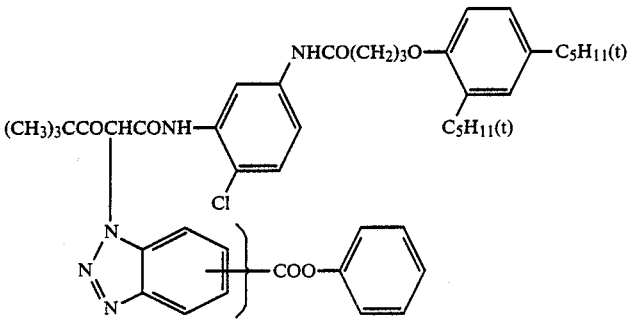

-continued
D-32
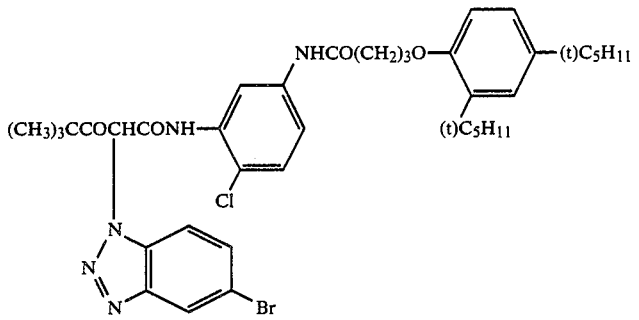
D-33
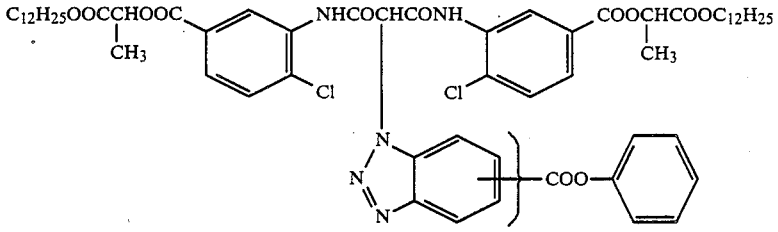
D-34
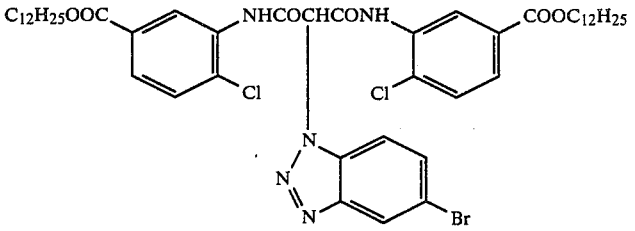
D-35
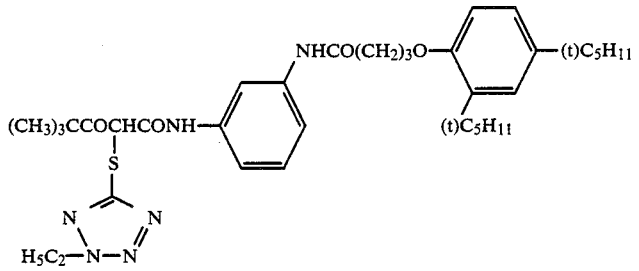
D-36
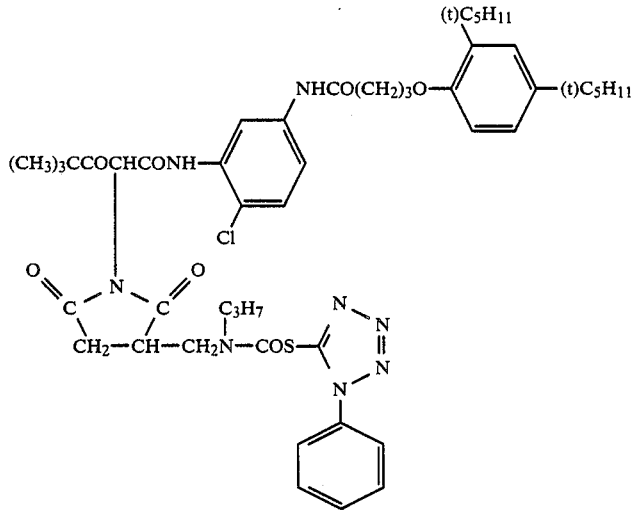

-continued
D-37
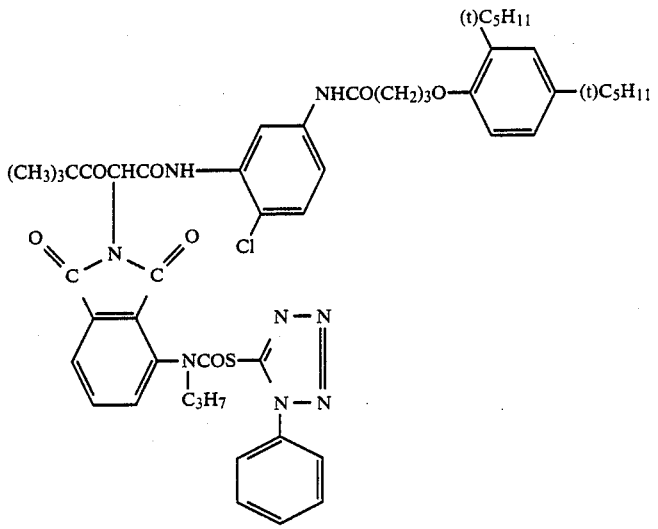
D-38
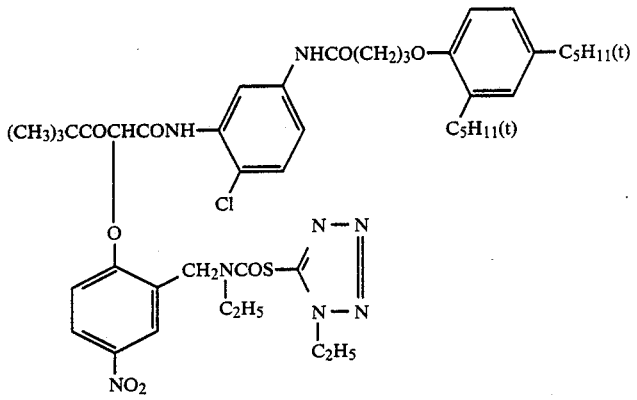
D-39
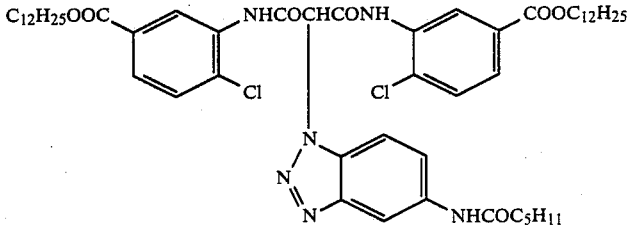
D-40
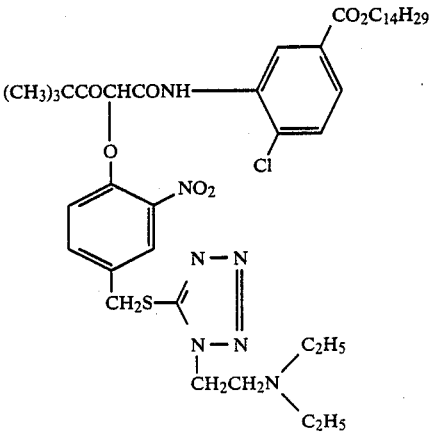
D-41
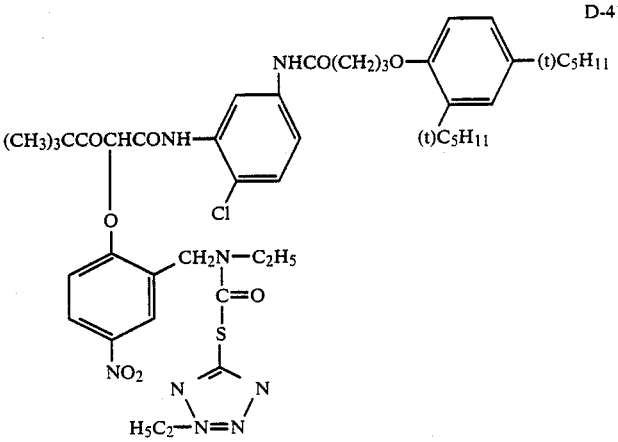

-continued
D-42
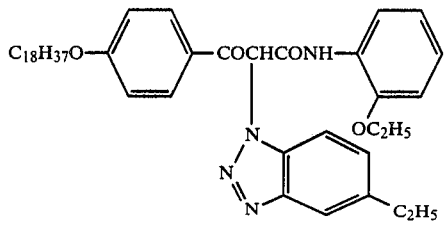
D-43
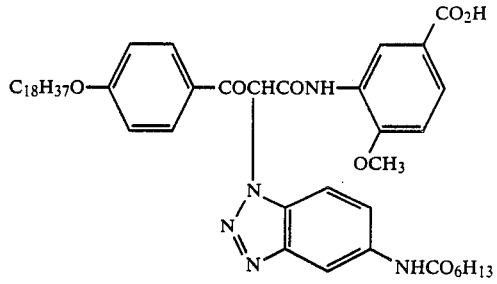
D-44
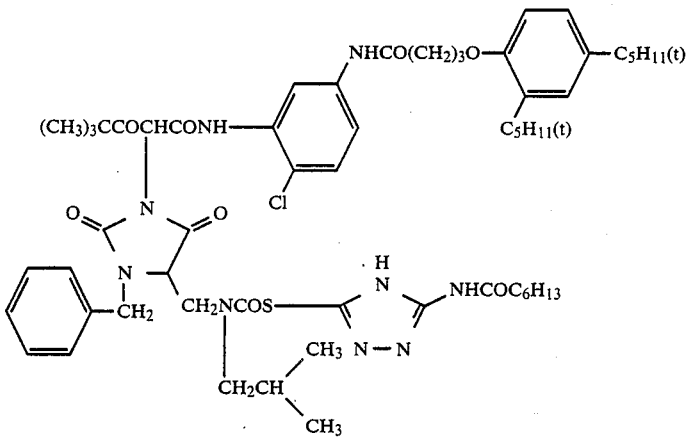
D-45
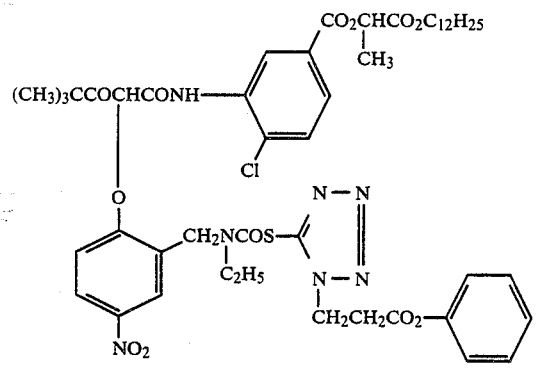
D-46
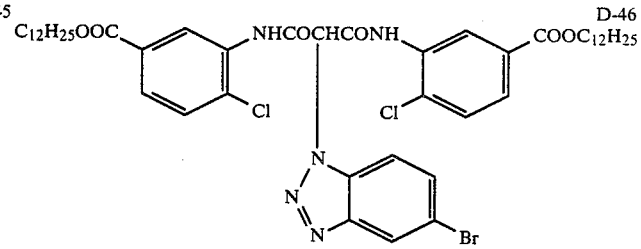
D-47
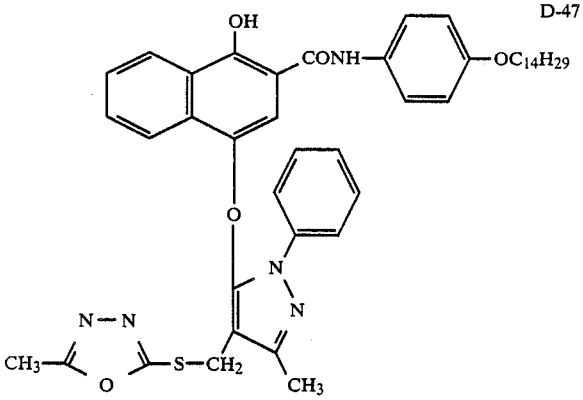
D-48
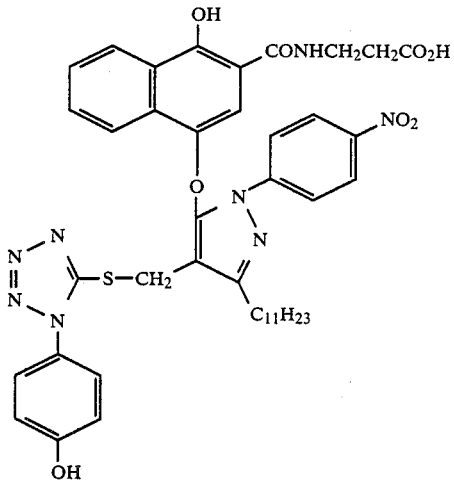
The above diffusible DIR compounds of the present invention can be easily prepared by the methods described in, for example, U.S. Pat. Nos. 3,227,554, 3,617,291, 3,933,500, 3,958,993, 4,149,886, 4,234,678, Japanese Patent Application (OPI) Nos. 13239/76, 56837/82, British Pat. Nos. 2,070,266, 2,072,363, and *Research Disclosure,* No. 212 (December 1981), RD No. 21228.

The cyan couplers of the general formula (I) of the present invention, even when processed with a fatigued or low oxidation power bleaching solution, cause no problem in color formation and produce an image having good fastness. These couplers, however, have such disadvantages that their preparation costs are high because a number of preparation steps are required for the preparation thereof, and that the degree of freedom in designing the coupler is small because of various limitations in the preparation thereof.

The cyan couplers of the general formula (II) of the present invention, even when processed with a fatigued or low oxidation power bleaching solution, cause no problem in color formation, and they can be easily prepared, their preparation costs are low, and the degree of freedom in designing the coupler is large. These couplers, however, have such disadvantages that the image storage stability is somewhat inferior to that of the couplers of the general formula (I), and that the exclusive use of the couplers of the general formula (II) is not always preferred from the viewpoint of image storage stability.

Accordingly, if the couplers of the general formula (I) and of the general formula (II) are used in combination, there can be obtained silver halide color light-sensitive material which even when processed with a fatigued or low oxidation power bleaching solution, causes no problem in color formation, is advantageous from the point of preparation costs, and further which has good image storage stability. These findings constitute the basis of the present invention.

The cyan couplers of the general formulae (I) and (II) of the present invention have a disadvantage of having a large sub-absorption in the shorter wavelength region, particularly the blue light region, as compared with the conventional cyan couplers. This sub-absorption is not desirable for color reproduction of the light-sensitive material. In order to minimize this unnecessary absorption, a yellow colored cyan color-forming coupler may be used. This technique, the so-called color masking method, has the disadvantage of lengthening the exposure time for printing the negative film to a color printing paper. On the other hand, the method of improving color reproduction by using the above DIR compounds to thereby utilize the interlayer effect which results from the use of such DIR compounds, and to thereby strongly inhibit development of the other layers, avoids such problems and is thus useful herein.

Particularly, in the case of the cyan couplers of the present invention, it is necessary to strongly inhibit the color formation of the blue-sensitive emulsion layer. In order to sufficiently increase the inhibition against the blue-sensitive emulsion layer which is coated apart from the red-sensitive emulsion layer in the usual layer construction for the photographic light-sensitive materials, it is particularly useful to use the diffusing DIR compounds described above, particularly the DIR couplers. Furthermore, problems such as a delay in development is encountered in obtaining the development inhibition effect with respect to the other layers by using large amounts of DIR compounds having insufficiently low diffusibility can be minimized.

Accordingly, by using the cyan couplers of the general formulae (I) and (II), and the DIR compounds having high diffusibility as described above in combination, there can be obtained a silver halide color light-sensitive material which even when processed with a fatigued or low oxidation power bleaching solution, causes no problem in color formation, is of low production cost, produces an image having good storage stability, and furthermore is excellent in color reproduction.

The silver halide color photographic light-sensitive material of the present invention may comprise a single light-sensitive silver halide emulsion layer or two or more emulsion layers having the same light-sensitive wavelength region but having different sensitivities. When the light-sensitive silver halide emulsion layer comprises two or more emulsion layers, the emulsion layers may be in adjacent relation with each other, or other light-sensitive silver halide emulsion layers having different light-sensitive wavelength regions, light-insensitive hydrophilic colloid layers, and/or the layers having such other functions may be interposed between the emulsion layers.

Examples of the light-insensitive hydrophilic colloid layers are an intermediate layer, an anti-halation layer, a yellow colloid layer, and a protective layer.

The cyan couplers of the general formulae (I) and (II) of the present invention are added to silver halide emulsion layers which are of the same color sensitivity and which usually are red-sensitive. The amount of the cyan couplers of the general formulae (I) and (II) is $1\times10^{-5}$ to 1 mol per mol of silver halide in the layer(s) to be added, preferably $1\times10^{-3}$ to $5\times10^{-1}$ mol and more preferably $1\times10^{-2}$ to $2.5\times10^{-1}$ mol per mol of silver halide in the layer(s) to be added. The molar ratio of the coupler of the general formula (I) to the coupler of the general formula (II), i.e., (I)/(II) is 0.01/1 to 100/1 and preferably 0.01/1 to 10/1.

Diffusible DIR compounds which are preferably used in combination in the present invention are added to the same color sensitive layer as that to which the cyan couplers of the present invention are present. The amount of the diffusible DIR compound added is preferably 0.001 to 0.5 mol, more preferably 0.002 to 0.2 mol, per mol of the total of the cyan couplers of the general formulae (I) and (II) of the present invention.

The couplers of the general formulae (I) and (II) of the present invention are dissolved in a high boiling solvent and dispersed in the same manner as that described in U.S. Pat. No. 2,322,027. In addition, the couplers may be dissolved in an aqueous alkali solution or a hydrophilic organic solvent (e.g., methanol, ethanol and acetone) and added.

The couplers of the general formulae (I) and (II) may be added to the same emulsion layer or may be added independently to different emulsion layers. It is also preferred to use the coupler of the general formula (II) having a high degree of freedom in coupler design as a 2-equivalent coupler.

As cyan couplers which can be used in combination with the couplers of the present invention, couplers capable of forming a cyan dye fast against moisture and temperature can be given. Typical examples of such couplers are 2,5-diacylamino-substituted phenol-based couplers as described in U.S. Pat. Nos. 2,772,162, 3,758,308, 4,126,396, 4,334,011, and 4,327,173, West German Patent Application (OLS) No. 3,329,729 and European Patent No. 121,365, and phenol-based couplers having a phenylureido group in the 2-position and an acylamino group in the 5-position as described in U.S. Pat. Nos. 3,446,622, 4,333,999, 4,451,559 and 4,427,767.

In the photographic emulsion layer of the photographic material of the present invention, any silver halide selected from silver bromide, silver iodobromide, silver iodochlorobromide, silver chlorobromide and silver chloride can be used. A preferred example of such silver halides is silver iodobromide containing not more than about 30% of silver iodide or silver iodochlorobromide containing not more than about 30% of silver iodide. A particularly preferred example is silver iodobromide containing about 2 to 25 mol% of silver iodide.

The silver halide grains in the photographic emulsion may be so-called regular grains having a regular crystal form, such as cubic, octahedral and tetradecahedral, or grains having an irregular crystal form, such as spherical, or grains having a crystal defect, as a twin planes, or composite grains thereof.

The silver halide grains may be small-sized grains having a particle diameter of not more than about 0.1 micron or large-sized grains having a projected area particle diameter of up to about 10 microns. Furthermore, a monodispersed emulsion having a narrow distribution of particle diameters or a polydispersed emulsion having a broad distribution of particle diameters may be employed.

Silver halide photographic emulsions which can be used in the present invention can be prepared by known methods such as the methods described in *Research Disclosure,* RD No. 17643 (December 1978), pp. 22–23, "I. Emulsion Preparation and Types" and ibid., RD No. 18716 (November 1979), page 648.

Photographic emulsions which are used in the present invention can be prepared by the methods described in P. Galfkides, *Chimie et Physique Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964). That is, any of the conventional methods such as an acidic method, the neutral method, the ammonia method and so forth can be used. In reaction a soluble silver salt and a soluble halide, any of the known methods such as the single jet method, the double jet method, a combination thereof and so forth can be employed. In addition, the method of forming grains in the presence of an excess of silver ions (the so-called reverse mixing method) can be used. As one example of the double jet method, a procedure in which the pAg of a liquid phase where silver halide is formed is kept constant (the so-called controlled double jet method) can be used. This controlled double jet method provides a silver halide emulsion in which the crystal form is regular and the particle size is nearly uniform.

Two or more silver halide emulsions prepared independently may be used in admixture with each other.

A silver halide emulsion containing the above regular grains can be prepared by controlling the pAg and pH during the formation of the grains. Details are described in *Photographic Science and Engineering,* Vol. 6, pp. 159–165 (1962), *Journal of Photographic Science,* Vol. 12, pp. 242–251 (1964), U.S. Pat. No. 3,655,394 and British Pat. No. 1,413,748.

A typical example of a monodispersed emulsion is one where the silver halide grains have an average particle diameter of more than about 0.1 micron, and at least about 95 wt% of the silver halide grains have a particle diameter falling within the range of the average particle diameter ±40%. An emulsion in which the average particle diameter is about 0.25 to 2 microns and at least about 95% (by weight or as number) of the silver halide grains have a particle diameter falling within the range of the average particle diameter ±20%. Such emulsions can be prepared by methods described in U.S. Pat. Nos. 3,574,628 and 3,655,394 and British Pat. No. 1,413,748. In addition, monodispersed emulsions as described in Japanese Patent Application (OPI) Nos. 8600/73, 39027/76, 83097/76, 137133/78, 48521/79, 99419/79, 37635/83, 49938/83, and so forth are preferably used in the present invention.

Tabular grains having an aspect ratio of not less than about 5 can be used in the present invention. These tabular grains can be easily prepared by the methods described in Gutoff, *Photographic Science and Engineering,* Vol. 14, pp. 248–257 (1970), U.S. Pat. Nos. 4,434,226, 4,414,310, 4,433,048 and 4,439,520, and British Pat. No. 2,112,157. The use of tabular grains provides advantages that the color sensitization efficiency using a sensitizing dye, the granularity and the sharpness are increased. These advantages are described in detail in the above-cited U.S. Pat. No. 4,434,226.

The crystal structure may be uniform, or may be such that the halogen composition is different between the inside portion and the outer layer, or it may be in a layer structure. These emulsion particles are described in British Pat. No. 1,027,146, U.S. Pat. Nos. 3,505,068 and 4,444,877 and Japanese Patent Application No. 248469/83 (corresponding to Japanese Patent Application (OPI) No. 143331/85). Silver halide grains having different compositions may be bonded together by epitaxial bonding, or they may be bonded to compounds other than silver halide, such as silver rhodanate and lead oxide. Such emulsion particles are described in U.S. Pat. Nos. 4,094,684, 4,142,900, 4,459,353, 4,349,622, 4,395,578, 4,433,501, 4,463,087, 3,656,962 and 3,852,067, British Pat. No. 2,038,792 and Japanese Patent Application (OPI) No. 162540/84.

A mixture of grains having various crystal forms may be used.

The emulsion is usually subjected to physical ripening, chemical ripening and spectral sensitization. Additives which are used during these steps are described in *Research Disclosure* RD Nos. 17643 and 18716. The pages and lines therein where the descriptions of the additives are described are shown in the Table below.

Known photographic additives which can be used in the present invention are described in the above-cited *Research Disclosures.* Citations to the descriptions concerning these additives are also shown in the Table below.

TABLE

| No. | Type of Additive | RD 17643 | RD 18716 |
|---|---|---|---|
| 1. | Chemical Sensitizer | Page 23 | Page 648, right column |
| 2. | Sensitivity Increasing Agent | | Page 648, right column |
| 3. | Spectral Sensitizer, Supersensitizer | Pages 23 to 24 | Page 648, right column to Page 649, right column |
| 4. | Brightening Agent | Page 24 | |
| 5. | Antifoggant and Stabilizer | Pages 24 to 25 | Page 649, right column |
| 6. | Light Absorber, Filter Dye, UV | Pages 25 to 26 | Page 649, right column to Page 650, left column |

TABLE-continued

| No. | Type of Additive | RD 17643 | RD 18716 |
|---|---|---|---|
| | Absorbers | | |
| 7. | Stain Preventing Agent | Page 25, right column | Page 650, left column to right column |
| 8. | Dye Image Stabilizer | Page 25 | |
| 9. | Hardener | Page 26 | Page 651, left column |
| 10. | Binder | Page 26 | Page 651, left column |
| 11. | Plasticizer, Lubricants | Page 27 | Page 650, right column |
| 12. | Coating Aid, Surfactant | Pages 26 to 27 | Page 650, right column |
| 13. | Static Preventing Agent | Page 27 | Page 650, right column |

Various color couplers can be used in the present invention. Specific examples of such couplers are described in the patents listed in the above cited *Research Disclosure,* RD No. 17643, VII-C to VII-G. As dye forming couplers, those couplers producing the three primary colors of the subtractive process (i.e., yellow, magenta and cyan) through color development are important. Specific examples of anti-diffusible 4-equivalent or 2-equivalent couplers are described in the patents listed in the above cited *Research Disclosure,* RD No. 17643, Clauses VII-C and D. In addition, the followings are preferably used in the present invention.

Typical examples of yellow couplers which can be used in the present invention are hydrophobic acylacetamide-based couplers having a ballast group. They are described in U.S. Pat. Nos. 2,407,210, 2,875,057 and 3,265,506. In the present invention, 2-equivalent yellow couplers are preferably used. Typical examples are yellow couplers having oxygen atom linked coupling off groups as described in U.S. Pat. Nos. 3,408,194, 3,447,928, 3,933,501 and 4,022,620, and yellow couplers having nitrogen-atom linked coupling off groups are described in Japanese Patent Publication No. 10739/83, U.S. Pat. Nos. 4,401,752 and 4,326,024, *Research Disclosure,* RD No. 18053 (April 1979), British Pat. No. 1,425,020, and West German Patent Application (OLS) Nos. 2,219,917, 2,261,361, 2,329,587 and 2,433,812. α-Pivaloylacetoanilide-based couplers are excellent in fastness, and particularly the light fastness of the formed dye. On the other hand, α-benzoylacetoacetoanilide-based couplers provide a high color density.

Examples of magenta couplers which can be used in the present invention are hydrophobic indazolone- or cyano-acetyl-based couplers having a ballast group (that is, a group capable of making couplers non-diffusible), of which 5-pyrazolone- and pirazoloazole-based couplers are preferred.

As 5-pyrazolone-based couplers, couplers substituted with an arylamino group or acylamino group in the 3-position are preferred in view of the hue of the formed dye and the color density. Typical examples of such couplers are described in U.S. Pat. Nos. 2,311,082, 2,343,703, 2,600,788, 2,908,573, 3,062,653, 3,152,896 and 3,936,015. As the coupling-off group of two-equivalent 5-pyrazolone-based couplers, a nitrogen-atom linked coupling-ff group as described in U.S. Pat. No. 4,310,619 and an arylthio group as described in U.S. Pat. No. 4,351,897 are particularly preferred. 5-Pyrazolone-based couplers having a ballast group as described in European Pat. No. 73,636 provide a high color density.

As pyrazoloazole-based couples, the pyrazolobenzimidazoles described in U.S. Pat. No. 3,369,879, preferably pyrazolo[5,1-c][1,2,4]triazoles disclosed in U.S. Pat. No. 3,725,067, pyrazolotetrazoles as disclosed in *Research Disclosure,* RD No. 24220 (June 1984) and Japanese Patent Application (OPI) No. 33552/85, and pyrazolopyrazoles as described in *Research Disclosure, RD NO.* 24230 (June 1984) and Japanese Patent Application (OPI) No. 43659/85 can be listed. In view of the decreased yellow sub-absorption of the formed dye and good light fastness, imidazo[1,2-b]pyrazoles as taught in U.S. Pat. No. 4,500,630 are preferred. Particularly preferred is pyrazolo[1,5-d][1,2,4]triazole disclosed in European Pat. No. 119,860A.

In order to correct the unnecessary absorption of the formed dye, the color light-sensitive material for photographing may be subjected to masking using a colored coupler in combination. Typical examples are the yellow colored magenta couplers disclosed in U.S. Pat. No. 4,163,670 and Japanese Patent Publication No. 39413/82, and magenta colored cyan couplers described in U.S. Pat. Nos. 4,004,929 and 4,138,258 and British Pat. No. 1,146,368. Other colored couplers are described in the aforementioned *Research Disclosure,* RD No. 17643, Clause VII-G.

Graininess can be improved by using in combination those couplers which produce a colored dye having controlled degree of diffusibility. In connection with these couplers, specific examples of magneta couplers are described in U.S. Pat. No. 4,366,237 and British Pat. No. 1,125,570, and specific examples of yellow, magenta and cyan couplers are described in European Pat. No. 96,570 and West German Patent Application (OLS) No. 3,234,533.

Dye forming couplers and the above-described special couplers may form polymers scuh as dimers or higher polymers. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

In the light-sensitive material of the present invention, couplers which imagewise release a nucleating agent or a development accelerator or a precursor thereof during development can be used. Specific examples of such compounds are described in British Pat. Nos. 2,097,140 and 2,131,188. Couplers which release a nucleating agent having an adsorption action onto silver halides are particularly preferred. Specific examples of such couplers are described in Japanese Patent Application (OPI) Nos. 157638/84 and 170840/84.

Suitable supports which can be used in the present invention are described in the aforementioned *Research Disclosure,* RD No. 17643, page 28 and ibid., RD No. 18716, page 647, right column to page 648, left column.

Development can be carried out by means of the usual methods described in the aforementioned *Research Disclosure,* RD No. 17643, pages 28–29 and ibid., RD No. 18716, page 651, left column to right column.

The silver halide color photographic material of the present invention is preferably processed with a color developer containing a color developing agent represented by the following formula or its salt:

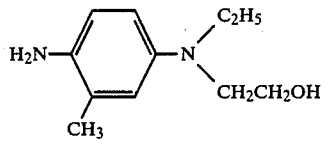

The color photographic material of the present invention is usually subjected to water washing or stabilization treatment after development, bleach-fixation or fixation.

For the water washing, two or more vessels are used and washing is carried out countercurrently to reduce the amount of water consumed. As the stabilization treatment, the multi-stage counter-current stabilization procedure as described in Japanese Patent Application (OPI) No. 8543/82 can be typically listed. For this treatment, 2 to 9 vessels of countercurrent baths are needed.

In a case where the water washing or stabilization treatment is carried out using a plurality of vessels, and the processing solution is supplemented by the multi-stage countercurrent method, it is particularly preferred that the amount of processing solution supplemented be 3 to 50 times the amount of the processing solution brought from the preceding bath per unit area of the silver halide photographic material to be processed.

Various compounds are added to the stabilization bath for the purpose of stabilizing an image. Typical examples of such compounds are various buffers (e.g., boric acid salts, metaboric acid salts, borax, phosphoric acid salts, carbonic acid salts, potassium hydroxide, sodium hydroxide, ammonia water, monocarboxylic acid, dicarboxylic acids and polycarboxylic acids or mixtures thereof) and formalin, which are used to adjust the pH of the film (e.g., pH 3 to 8). In addition, if necessary, a hard water softening agent (e.g., an inorganic phosphoric acid, aminopolycarboxylic acid, organic phosphoric acid, aminopolyphosphoric acid or phosphonocarboxylic acid), a sterilizer (e.g., benzoisothiazoline, isothiazolone, 4-thiazolinbenzimidazole or a halogenated phenol), a surfactant, a brightening agent, a hardener and so forth can be added. These compounds can be used alone or in combination with each other.

Preferably various ammonium salts such as ammonium chloride, ammonium nitrate, ammonium sulfate, ammonium phosphate, ammonium sulfite and ammonium thiosulfate are added as film pH adjusting agents after the processing.

The present invention can be applied to various color light-sensitive materials. Typical examples of such color light-sensitive materials are color negative films for general purpose or movies, color reversal films for slides or TV, color paper, color positive film and color reversal paper. The present invention can also be applied to black-and-white light-sensitive material utilizing the three coupler mixing procedures as described in *Research Disclosure,* RD No. 17123 (July 1978).

The present invention is described in greater detail with reference to the following example. This example is not to be considered as limiting of the present invention.

EXAMPLE

On a cellulose triacetate film support were provided layers having the formulations shown below to prepare a light-sensitive material. In this way, Samples 101 to 112 were prepared.

The amount of silver halide coated is indicated as the amount of silver coated (g/m$^2$). The amounts of gelatin and coupler dispersion oil coated are indicated in g/m$^2$. The amounts of sensitizing dye and coupler coated are indicated in mols per mol of silver halide in the same layer.

First layer: Antihalation Layer
- Gelatin layer containing black colloidal silver
- Amount of gelatin coated: 1.2

Second Layer: Intermediate Layer
- Gelatin layer containing a 2,5-di-tert-pentadecylhydroquinone dispersion, Coupler EX-1 and silver iodobromide (silver iodide, 1 mol%; average particle diameter: 0.07 μm)
- Amount of gelatin coated: 1.2
- Oil I for emulsification and dispersion: 0.25

Third Layer: First Red-Sensitive Emulsion Layer
- Silver iodobromide emulsion (silver iodide, 6 mol%; average particle diameter, 0.7 μm)
- Amount of silver coated: 1.8
- Sensitizing Dye I: $4.2\times10^{-4}$
- Sensitizing Dye II: $1.4\times10^{-4}$
- Coupler shown in Table 1:
- Amount of gelatin coated: 1.4
- Oil I for coupler dispersion: 0.3

Fourth Layer: Second Red-Sensitive Emulsion Layer
- Silver iodobromide emulsion (silver iodide, 10 mol%; average particle diameter, 1.3 μm)
- Amount of silver coated: 1.8
- Sensitizing Dye I: $3.2\times10^{-4}$
- Sensitizing Dye II: $1.1\times10^{-4}$
- Coupler shown in Table 1
- Amount of gelatin coated: 1.1
- Oil I for coupler dispersion: 0.25
- Oil II for coupler dispersion: 0.1

Fifth Layer: Intermediate Layer
- Gelatin layer
- Amount of gelatin coated: 1.0

Sixth Layer: First Green-Sensitive Emulsion Layer
- Silver iodobromide emulsion (silver iodide, 4 mol%; average particle diameter, 0.9 μm)
- Amount of silver coated: 0.6
- Sensitizing Dye III: $4.8\times10^{-4}$
- Sensitizing Dye IV: $1.9\times10^{-4}$
- Coupler EX-6: 0.078
- Coupler EX-7: 0.017
- Coupler EX-8: 0.007
- Amount of gelatin coated: 0.5
- Oil I for coupler dispersion: 0.18

Seventh Layer: Second Green-Sensitive Emulsion Layer
- Silver iodobromide emulsion (silver iodide, 6 mol%; average particle diameter, 0.85 μm)
- Amount of silver coated: 1.5
- Sensitizing Dye III: $4.0\times10^{-4}$
- Sensitizing Dye IV: $1.6\times10^{-4}$
- Coupler EX-9: 0.023
- Coupler EX-7: 0.003
- Coupler EX-8: 0.001
- Amount of gelatin coated: 1.6
- Oil I for coupler dispersion: 0.4
- Oil II for coupler dispersion: 0.1

Eighth Layer: Third Green-Sensitive Emulsion Layer
- Silver iodobromide emulsion (silver iodide, 10 mol%; average particle diameter, 1.4 μm)
- Amount of silver coated: 2.0
- Sensitizing Dye III: $3.6\times10^{-4}$ Sensitizing Dye IV: $1.2\times10^{-4}$
Coupler EX-9: 0.01
Coupler Ex-10: 0.001
Amount of gelatin coated: 2.2
Oil I for coupler dispersion: 0.9
Oil II for coupler dispersion: 0.1

Ninth Layer: Yellow Filter Layer
Gelatin layer prepared using a dispersion of yellow colloidal silver and 2,5-di-tert-pentadecylhydroquinone in an aqueous gelatin solution
Amount of of gelatin coated: 0.9

Tenth Layer: First Blue-Sensitive Emulsion Layer
Silver iodobromide emulsion (silver iodide, 6 mol%; average particle diameter, 0.8 μm)
Amount of silver coated: 0.5
Coupler EX-11: 0.32
Coupler EX-12: 0.006
Amount of gelatin coated: 1.2
Oil I for coupler dispersion: 0.25

Eleventh Layer: Second Blue-Sensitive Emulsion Layer
Silver iodobromide emulsion (silver iodide, 10 mol%, average particle diameter, 1.2 μm)
Amount of silver coated: 0.6
Coupler EX-11: 0.05
Amount of gelatin coated: 0.5
Oil I for coupler dispersion: 0.05

Twelfth Layer: Third Blue-Sensitive Emulsion Layer
Silver iodobromide emulsion (silver iodide, 10 mol%; average particle diameter, 2.0 μm)
Amount of silver coated: 0.8
Sensitizing Dye V: $1.6\times10^{-4}$
Coupler EX-11: 0.039
Amount of gelatin coated: 0.4
Oil I for coupler dispersion: 0.15

Thirteenth Layer: First Protective Layer
Gelatin layer
Amount of gelatin coated: 0.7

Fourteenth Layer: Second Protective Layer
Gelatin layer containing silver iodobromide (silver iodide, 1 mol%; average particle diameter, 0.07 μm) and polymethyl methacrylate particles (diameter, about 1.5 μm)
Amount of gelatin coated: 1.0

In addition to the above ingredients, gelatin hardeners H-1 and H-2 and a surfactant were added to each layer. The compounds used in the preparation of each sample are listed below:

Sensitizing Dye I
Anhydro-5,5'-dichloro-3,3'-di-(γ-sulfopropyl)-9-ethylthiacarbocyanine hydroxide pyridinium salt Sensitizing Dye II
Anhydro-9-ethyl-3,3'-di-(γ-sulfopropyl)-4,5,4',5'-dibenzothiacarbocyanine hydroxide triethylamine salt Sensitizing Dye III
Anhydro-9-ethyl-5,5'-dichloro-3,3'-di-(γ-sulfopropyl)-oxacarbocyanine sodium salt Sensitizing Dye IV
Anhydro-5,6,5',6'-tetrachloro-1,1'-diethyl-3,3'-di-{β-[β-(γ-sulfopropoxy)ethoxy]ethyl}imidazolocarbocyanine hydroxide sodium salt Sensitizing Dye V
Anhydro-5,5'-dichloro-3,3'-di-(δ-sulfobutyl)-thiacyaninetriethyl ammonium salt Coupler EX-1

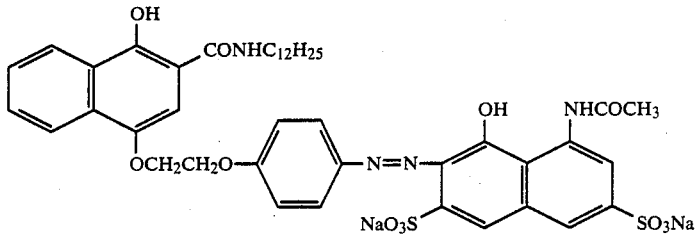

Coupler EX-2

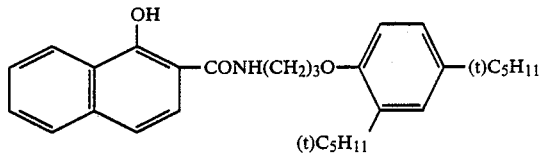

Coupler EX-3

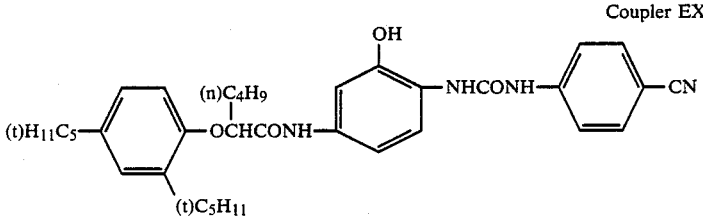

Coupler EX-4

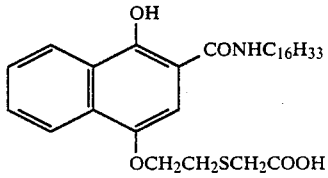

-continued
Coupler EX-5
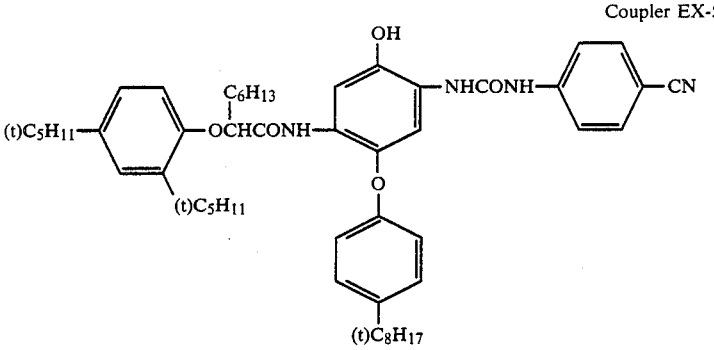
Coupler EX-6
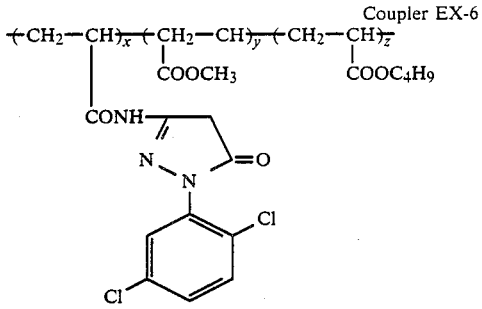
x/y + z = 1
y/z = 1
molecular weight, about 40,000
Coupler EX-7
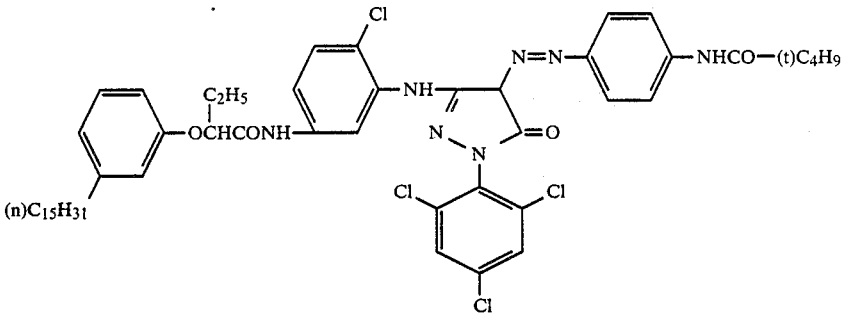
Coupler EX-8
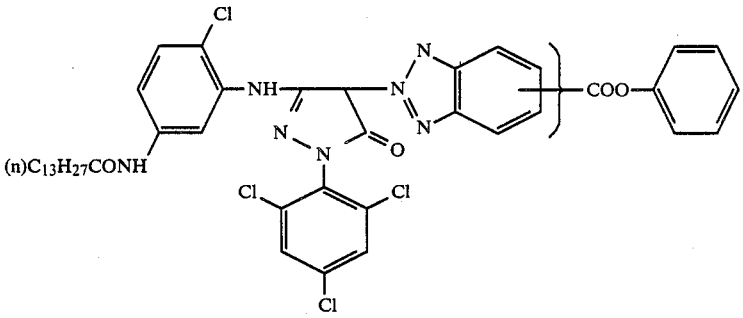
Coupler EX-9
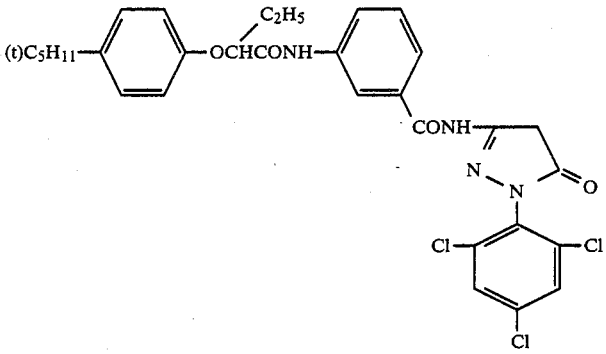
Coupler EX-10
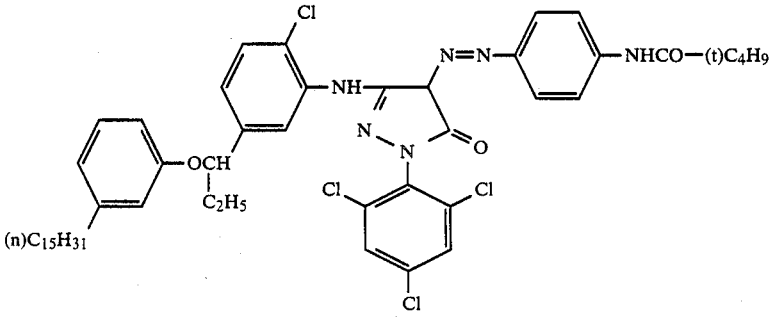

-continued

Coupler EX-11

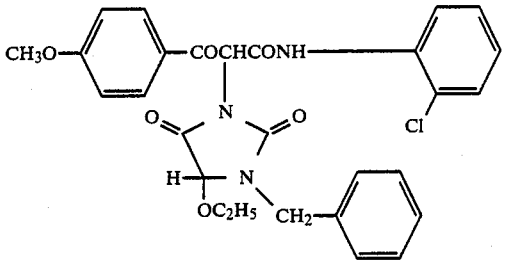

Coupler EX-12

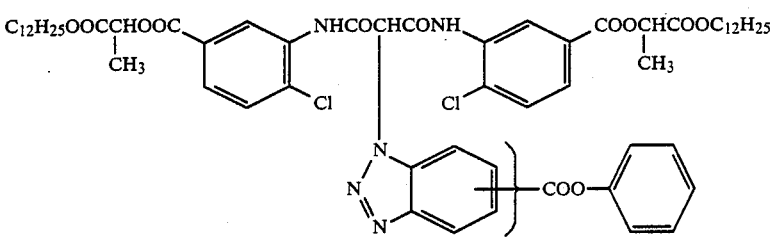

Oil I for Coupler Dispersion

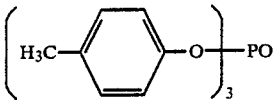

Oil II for Coupler Dispersion

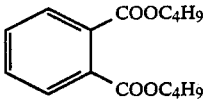

Oil III for Coupler Dispersion $(C_6H_{13}O)_3PO$

H-1

$(CH_2{=}CHSO_2CH_2CONHCH_2)_2$

H-2

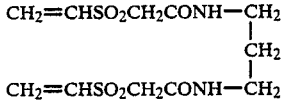

Coupler EX-13

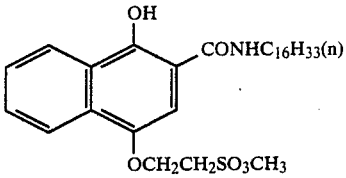

Coupler EX-14

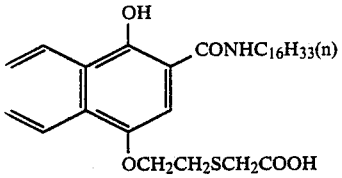

Coupler EX-15

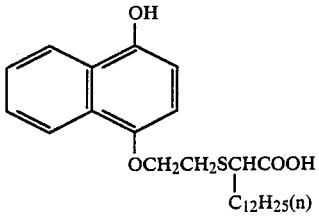

Samples 101 to 112 were each exposed for sensitometry and then subjected to the following processings at 38° C.

1. Color development: 3 min. 15 sec.
2. Bleaching: 6 min. 30 sec.
3. Water washing: 3 min. 15 sec.
4. Fixation: 4 min. 20 sec.
5. Water washing: 3 min. 15 sec.
6. Stabilization: 1 min. 5 sec.

The composition of the processing solution at each step was as follows.

Color Development
- Sodium nitrilotriacetate: 1.0 g
- Sodium sulfite: 4.0 g
- Sodium carbonate: 30.0 g
- Potassium bromide: 1.4 g
- Hydroxylamine sulfate: 2.4 g
- 4-(N-ethyl-N-β-hydroxyethylamino)-2-methylaniline sulfate: 4.5 g
- Water to make: 1 liter Bleaching Solution
- Ammonium bromide: 160.0 g
- Ammonia water (28%): 25.0 ml
- Sodium ethylenediaminetetraacetato ferrate: 130.0 g
- Glacial acetic acid: 14.0 ml
- Water to make: 1 liter Fixing Solution
- Sodium tetrapolyphosphate: 2.0 g
- Sodium sulfite: 4.0 g
- Ammonium thiosulfate (70%): 175.0 ml
- Sodium hydrogen phosphite: 4.6 g
- Water to make: 1 liter Stabilizer
- Formalin: 8.0 ml
- Water to make: 1 liter The above described processing is hereafter referred to as "Development Processing A".

The developed samples thus obtained were each tested for color image fastness under the following two conditions:

(1) the sample was stored in a dark place at 80° C. for 14 days.

(2) the emulsion coated surface of the sample was exposed for 7 days to the fluorescent lamp fading tester (10,000 lux). The results are shown in Table 1.

Thereafter, Development Processing B was applied in the same manner as in Development Processing A except that the processing solution for the bleach processing in Development Processing A was replaced with a processing solution having the formulation as shown below. This bleaching solution was similar to and thus imitated a fatigued bleaching solution resulting from processing a large number of light-sensitive materials.

Development Processing (B)

Formulation of Bleaching solution
(D-1)
Ammonium bromide: 160.0 g
Ammonia water (28%): 7.1 ml
Sodium ethylenediaminetetraacetato ferrate: 117 g
Glacial acetic acid: 14 ml
Water to make: 900 ml
(D-2)
Sodium ethylenediaminetetraacetato ferrate: 130 g
Water to make: 1 liter Steel wool was introduced in (D-2) and after sealing, the solution was allowed to stand to thereby convert Fe(III)-EDTA into Fe(II)-EDTA. A 100 ml portion of the resulting solution was added into (D-1) to prepare a bleaching solution for Development Processing (B). As noted above, Development Processing (B) was the same as Development Processing (A) except that the above bleaching solution for Development Processing (B) was used.

Samples 101 to 112 which had been processed by Development Processings (A) and (B) were measured for their density using red light. The results are shown in Table 1.

TABLE 1

| Sample No. | Coupler Added to First Red-Sensitive Layer (amount*) | Coupler Added to Second Red-Sensitive Layer (amount*) | Image Residual Ratio (%) 80° C., 14 days | Image Residual Ratio (%) Fluorescent Lamp** | Color Density*** |
|---|---|---|---|---|---|
| 101 | I-2 (0.048), EX-1 (0.002) | I-7 (0.017) | 99 | 99 | 1.50 |
| 102 | I-2 (0.048), EX-1 (0.002) | I-11 (0.017) | " | 98 | " |
| 103 | I-2 (0.048), EX-1 (0.002) | I-12 (0.017) | " | 99 | " |
| 104 | I-2 (0.048), EX-1 (0.002) | II-9 (0.017) | 97 | 98 | 1.49 |
| 105 | I-2 (0.048), EX-1 (0.002), D-14 (0.002) | II-9 (0.017) | " | " | " |
| 106 | I-2 (0.048), EX-1 (0.002) | II-10 (0.017) | " | 99 | " |
| 107 | I-2 (0.048), EX-1 (0.002), D-14 (0.002) | II-10 (0.017) | " | " | 1.48 |
| 108 | I-2 (0.048), EX-1 (0.002) | II-12 (0.017) | " | 98 | " |
| 109 | I-2 (0.048), EX-1 (0.002), D-14 (0.002) | II-12 (0.017) | " | " | " |
| 110 | I-2 (0.048), EX-1 (0.002) | EX-13 (0.017) | 79 | 93 | 1.30 |
| 111 | I-2 (0.048), EX-1 (0.002) | EX-14 (0.017) | 80 | 92 | 1.28 |
| 112 | I-2 (0.048), EX-1 (0.002) | EX-15 (0.017) | 82 | 93 | 1.29 |

Samples 101, 102, 103, 110, 111, 112: Comparative Examples
Samples 104 to 109: Examples of the present invention
*Amount per mol of silver
**10,000 lux, 7 days
***Measured in Development Processing (B) at exposure amount providing density of 1.5 in Development Processing (A).

It is apparent from the results shown in Table 1 that in the Samples of the present invention (104 to 109), the reduction in color density when processing with a fatigued bleaching solution is small and that the color image residual ratio is good as compared with Comparative Samples (110 to 112), and that Samples of the present invention can get the similar quality to that of Comparative Samples (101 to 103).

Samples 104 to 109 were subjected to the test as described below from the viewpoint of color reproductivity. That is, the samples were subjected to gradation exposure through a red-colored filter and then to the same processing as described above and, thereafter, as shown in the drawing, the difference between the yellow density at a point at which the difference between the cyan density at an unexposed area and the cyan density formed by red light exposure is 0.5 or 1.5, and the yellow density at the unexposed area (ΔY 0.5 and ΔY 1.5) was measured. The reproduction of red in printing a color paper becomes worse as this difference becomes higher. These results are shown in Table 2.

TABLE 2

| Sample No. | ΔY 0.5 | ΔY 1.5 |
|---|---|---|
| 104 | 0.06 | 0.17 |
| 105 | 0.04 | 0.13 |
| 106 | 0.05 | 0.18 |
| 107 | 0.04 | 0.13 |
| 108 | 0.05 | 0.17 |
| 109 | 0.04 | 0.13 |

It is apparent from the results of Table 2 that Samples (105, 107, 109) to which the diffusible DIR compound (D-14) was added were reduced in yellow sub-absorption and that they were excellent in color reproduction as compared with Samples (104, 106, 108) to which no diffusible DIR compound was added.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A silver halide color photographic material comprising a support and at least one red-sensitive emulsion layer, at least one green-sensitive emulsion layer and at least one blue-sensitive emulsion layer on the support, which contains at least one cyan dye forming coupler represented by the general formula (I) and at least one cyan dye forming coupler represented by the general formula (II):

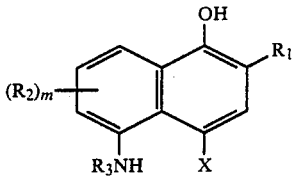

(I)

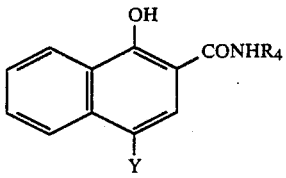

(II)

wherein $R_1$ represents $—CONR_5R_6$, $—NHCOR_5$, $—NHCOOR_7$, $—NHSO_2R_7$, $—NHCONR_5R_6$ or $—NHSO_2NR_5R_6$, $R_2$ represents a group which can be substituted in the naphthol ring, m represents 0 or an integer of 1 to 3, $R_3$ represents a monovalent group, $R_4$ represents an aromatic group, and X and Y each represents a hydrogen atom or a group capable of being released through a coupling reaction with an oxidized product of aromatic primary amine developing agent; $R_5$ and $R_6$ may be the same or different and each represents a hydrogen atom, an aliphatic group, an aromatic group or a heterocyclic group, and $R_7$ represents an aliphatic group, an aromatic group or a heterocyclic group; and further m is 2 or 3, the $R_2$ groups may be the same or different and may combine together to form a ring, or $R_2$ and $R_3$ or $R_3$ and X, respectively, may combine together to form a ring.

2. A silver halide color photographic material as claimed in claim 1, wherein $R_5$ and $R_6$ each represents a hydrogen atom, an aliphatic group having 1 to 30 carbon atoms, an aromatic group having 6 to 30 carbon atoms, or a heterocyclic group having 2 to 30 carbon atoms, and $R_7$ represents an aliphatic group having 1 to 30 carbon atoms, an aromatic group having 6 to 30 carbon atoms, or a heterocyclic group having 2 to 30 carbon atoms.

3. A silver halide color photographic material as claimed in claim 1, wherein $R_2$ represents a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, or an imido group.

4. A silver halide color photographic material as claimed in claim 1, wherein $R_3$ represents a monovalent group represented by the general formula (III):

$R_8(Z)_n$—(III)

wherein

Z represents >NH, >CO or $>SO_2$, n represents 0 or 1, and $R_8$ represents a hydrogen atom, an aliphatic group having 1 to 30 carbon atoms, an aromatic group having 6 to 30 carbon atoms, a heterocyclic group having 1 to 30 carbon atoms, $—OR_9$, $—COR_9$,

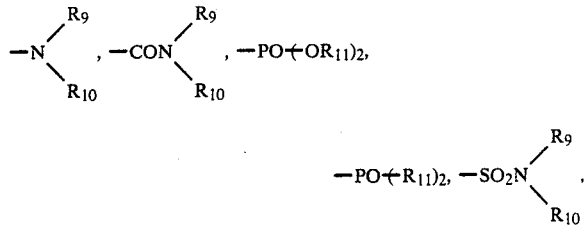

$—CO_2R_{11}$, $—SO_2R_{11}$ or $—SO_2OR_{11}$ wherein $R_9$ and $R_{10}$ each represents a hydrogen atom, an aliphatic group having 1 to 30 carbon atoms, an aromatic group having 6 to 30 carbon atoms, or a heterocyclic group having 2 to 30 carbon atoms, and $R_7$ represents an aliphatic group having 1 to 30 carbon atoms, an aromatic group having 6 to 30 carbon atoms, or a heterocyclic group having 2 to 30 carbon atoms.

5. A silver halide color photographic material as claimed in claim 1, wherein $R_4$ represents an aromatic group having 6 to 30 carbon atoms.

6. A silver halide color photographic material as claimed in claim 5, wherein said aromatic group is substituted with one or more replaceable group.

7. A silver halide color photographic material as claimed in claim 6, wherein said replaceable group represents a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, an aliphatic group, or an aliphatic oxycarbonyl group.

8. A silver halide color photographic material as claimed in claim 1, wherein said group capable of being released through the coupling reaction with the oxidized product of the aromatic primary amine developing agent represents a halogen atom, $—OR_{12}$, $—SO_{12}$, $—OC(=O)R_{12}$, $—NHCOR_{12}$, $—NHC(=O)SR_{12}$, $—OC(=O)—OR_{12}$, $—OC(=O)NHR_{12}$, and aromatic azo group having 6 to 30 carbon atoms, or a heterocyclic group having 1 to 30 carbon atoms and linked through a nitrogen atom to the coupling active position of the coupler, wherein $R_{12}$ represents an aliphatic group having 1 to 30 carbon atoms, an aromatic group having 6 to 30 carbon atoms or a heterocyclic group having 2 to 30 carbon atoms.

9. A silver halide color photographic material as claimed in claim 1, wherein $R_1$ represents $—CONR_5R_6$.

10. A silver halide color photographic material as claimed in claim 1, wherein m represents 0.

11. A silver halide color photographic material as claimed in claim 4, wherein n represents 0, and $R_8$ represents —$COR_9$, —$COOR_{11}$, —$SO_2R_{11}$, —$CONR_9R_{10}$, or —$SO_2NR_9R_{10}$.

12. A silver halide color photographic material as claimed in claim 11, wherein $R_8$ represents —$COOR_{11}$, —$COR_9$, or —$SO_2R_{11}$.

13. A silver halide color photographic material as claimed in claim 12, wherein $R_8$ represents —$COOR_{11}$.

14. A silver halide color photographic material as claimed in claim 5, wherein $R_4$ represents a naphthyl group, or a phenyl group having an aliphatic oxy group or a halogen atom in the 2-position thereof.

15. A silver halide color photographic material as claimed in claim 8, wherein said group capable of being released through the coupling reaction with the oxidized product of the aromatic primary amine developing agent represents a hydrogen atom, a chlorine atom, an aliphatic oxy group, an aromatic oxy group or a carbamoyloxy group.

16. A silver halide color photographic material as claimed in claim 1, wherein said coupler represented by the general formula (I) and said coupler represented by the general formula (II) each represents a homopolymer or a copolymer of an addition polymerizable ethylenically unsaturated compound having a cyan dye forming coupler residue.

17. A silver halide color photographic material as claimed in claim 16, wherein said homopolymer contains one or more kinds of the repeating units represented by the general formula (IV) and said copolymer contains one or more kinds of the repeating units represented by the general formula (IV) and one or more of non-color forming ethylenically unsaturated monomers as comonomers, (IV)

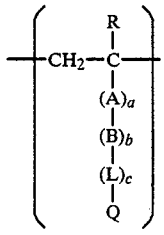

wherein

R represents a hydrogen atom, an alkyl group having 1 to 4 carbon atoms, or a chlorine atom, A represents —CONH—, —COO—, or a substituted or unsubstituted phenylene group, B represents a substituted or unsubstituted alkylene group, a phenylene group, or an aralkylene group, L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—, a, b and c each represents 0 or 1, and Q represents a cyan coupler residue resulting from removal of a hydrogen atom other than the hydrogen atom of the hydroxyl group in the 1-position from the coupler represented by the general formula (I) or (II).

18. A silver halide color photographic material as claimed in claim 1, wherein said silver halide color photographic material further contains DIR couplers represented by the general formula (V):

$$A\text{-}(Y')_m \qquad (V)$$

wherein A represents a coupler component, m represents 1 or 2, and Y' represents a group linked to the coupler component A at the coupling position thereof and released through reaction with an oxidized color developing agent, and represents a development inhibitor having a high diffusibility or a compound capable of releasing a development inhibitor.

19. A silver halide color photographic material as claimed in claim 18, wherein Y' represents the general formulae (VI) to (XI):

(VI)

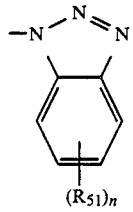

(VII)

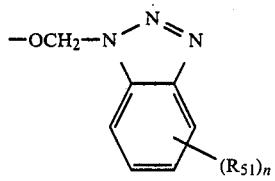

(VIII)

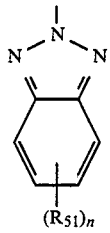

(IX)

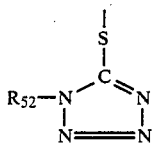

(X)

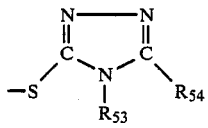

(XI)

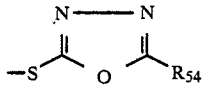

wherein $R_{51}$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxyl group, an alkoxycarbonylamino group, an alkylthio group, an arylthio group, an aryl group, a heterocyclic group, a cyano group, an alkylsulfonyl group or an aryloxycarbonylamino group, n represents 1 or 2, $R_{52}$ represents an alkyl group, an aryl group or a heterocyclic group, $R_{53}$ represents a hydrogen atom, an alkyl group, an aryl group or a heterocyclic group, and $R_{54}$ represents a hydrogen atom, an alkyl group, an aryl group, a halogen atom, an acylamino group, an alkoxycarbonylamino group, an aryloxycarbonylamino, an alkanesulfonamido group, a cyano group, a heterocyclic group, an alkylthio group or an amino group.

20. A silver halide color photographic material as claimed in claim 1, wherein said couplers of the general formulae (I) and (II) are added to red sensitive silver halide emulsion layer.

21. A silver halide color photographic material as claimed in claim 1, wherein the molar ratio of said coupler of the general formula (I) to said coupler of the general formula (II) is 0.01/1 to 100/1.

22. A silver halide color photographic material as claimed in claim 21, wherein said molar ratio is 0.01/1 to 10/1.

23. A silver halide color photographic material as claimed in claim 18, wherein the amount of said DIR coupler added is 0.001 to 0.5 mol per mol of the total of the couplers of the general formulae (I) and (II).

* * * * *